US010594036B2

(12) United States Patent
Iida et al.

(10) Patent No.: US 10,594,036 B2
(45) Date of Patent: Mar. 17, 2020

(54) ANTENNA AND VEHICLE

(71) Applicant: Panasonic Intellectual Property Management Co., Ltd., Osaka (JP)

(72) Inventors: Yuki Iida, Tokyo (JP); Koichi Tsumura, Kanagawa (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 115 days.

(21) Appl. No.: 16/024,930

(22) Filed: Jul. 2, 2018

(65) Prior Publication Data

US 2019/0013585 A1 Jan. 10, 2019

(30) Foreign Application Priority Data

Jul. 6, 2017 (JP) ..... 2017-132925
Mar. 26, 2018 (JP) ..... 2018-058930

(51) Int. Cl.

| | |
|---|---|
| ***H01Q 1/24*** | (2006.01) |
| ***H01Q 9/04*** | (2006.01) |
| ***H01Q 13/10*** | (2006.01) |
| ***H01Q 13/08*** | (2006.01) |

(52) U.S. Cl.
CPC ..... *H01Q 9/0435* (2013.01); *H01Q 1/243* (2013.01); *H01Q 9/045* (2013.01); *H01Q 13/08* (2013.01); *H01Q 13/106* (2013.01)

(58) Field of Classification Search
CPC .... H01Q 9/0435; H01Q 13/106; H01Q 13/08; H01Q 1/243; H01Q 9/045; H01Q 1/38; H01Q 21/065; H01Q 9/0407; H01Q 9/0414; H01Q 19/005
See application file for complete search history.

(56) References Cited

FOREIGN PATENT DOCUMENTS

| | | | |
|---|---|---|---|
| JP | 63-088904 | 4/1988 | |
| JP | 9-246852 | 9/1997 | |
| JP | 2004-349928 | 12/2004 | |
| JP | 2007-059966 | 3/2007 | |
| JP | 2012-235351 | 11/2012 | |
| JP | 2016131786 | * 7/2016 | ..... H01Q 3/24 |

* cited by examiner

*Primary Examiner* — Dameon E Levi
*Assistant Examiner* — David E Lotter
(74) *Attorney, Agent, or Firm* — Greenblum & Bernstein, P.L.C.

(57) ABSTRACT

A feed element is disposed over a surface of a first conductor. A second conductor is disposed at a distance from the feed element greater than a distance between the feed element and the surface. The second conductor has a second shape that is a sheet-like shape in plan view. The second conductor is disposed to overlap the surface of the feed element. At least a part of the third conductor is located closer to the first conductor than the second conductor is located, in a direction perpendicular to the surface of the second conductor. The at least part of the third conductor is located farther than a part of the second conductor with respect to the feed element. A second distance between the at least part of the third conductor and the first conductor is less than twice a first distance between the feed element and the first conductor.

20 Claims, 24 Drawing Sheets

300

300

ANTENNA AND VEHICLE

The present application claims the benefit of foreign priorities of Japanese patent application 2017-132925 filed on Jul. 6, 2017 and Japanese patent application 2018-058930 filed on Mar. 26, 2018, the contents all of which are incorporated herein by reference.

BACKGROUND

1. Technical Field

The present disclosure relates to an antenna technique, and particularly relates to an antenna having a feed element disposed on a substrate, and a vehicle.

2. Description of the Related Art

Microstrip antennas and patch antennas, for example, are used to achieve small antennas. Such antennas have a ground layer formed on one side of a substrate and a strip conductor formed on the other side (see, for example, Unexamined Japanese Patent Publication No. 2004-349928).

SUMMARY

The present disclosure provides a technique for achieving antenna radiation pattern suited for required applications.

According to an aspect of the present disclosure, an antenna includes a first conductor, a feed element, a second conductor, and a third conductor. The first conductor has a surface having a first shape in plan view. The feed element is disposed over the surface of the first conductor. The second conductor is disposed over the surface of the first conductor at a distance from the feed element. The distance is greater than a distance between the feed element and the surface. The second conductor has a second shape that is a sheet-like shape in plan view. The second conductor is disposed to overlap the surface of the first conductor when viewed from a direction perpendicular to the surface of the first conductor. The third conductor is electrically connected to the second conductor at least in terms of high frequency. At least a part of the third conductor is located closer to the first conductor than the second conductor is located, in the direction perpendicular to the surface of the first conductor. The first shape is larger in area than the second shape. The at least the part of the third conductor is located farther than a part of the second conductor with respect to the feed element in a direction along the surface of the first conductor. The third conductor is not electrically connected to the first conductor in terms of direct current. A first distance exists between the feed element and the first conductor. A second distance exists between the at least the part of the third conductor and the first conductor. The second distance is less than twice the first distance.

According to another aspect of the present disclosure, a vehicle includes an antenna, and a supporting member configured to support the antenna. The antenna includes a first conductor, a feed element, a second conductor, and a third conductor. The first conductor has a surface having a first shape in plan view. The feed element is disposed over the surface of the first conductor. The second conductor disposed over the surface of the first conductor at a distance from the feed element. The distance is greater than a distance between the feed element and the surface. The second conductor has a second shape that is a sheet-like shape in plan view. The second conductor is disposed to overlap the surface of the first conductor when viewed from a direction perpendicular to the surface of the first conductor. The third conductor is electrically connected to the second conductor at least in terms of high frequency. At least a part of the third conductor is located closer to the first conductor than the second conductor is located, in the direction perpendicular to the surface of the first conductor. The first shape is larger in area than the second shape. The at least the part of the third conductor is located farther than a part of the second conductor with respect to the feed element in a direction along the surface of the first conductor. The third conductor is not electrically connected to the first conductor in terms of direct current. A first distance exists between the feed element and the first conductor. A second distance exists between the at least the part of the third conductor and the first conductor. The second distance is less than twice the first distance. The feed element and the second conductor are disposed along a predetermined direction parallel to the surface of the first conductor. The supporting member supports the antenna, with the predetermined direction corresponding to a traveling direction of the vehicle.

According to the present disclosure, antenna radiation pattern suited for required applications is achieved.

DETAILED DESCRIPTION

Prior to describing exemplary embodiments of the present disclosure, issues concerning conventional techniques will be discussed briefly. Radiation pattern of a patch antenna can be changed by loading a parasitic element, which is called a director, in the vicinity of a feed element serving as a strip conductor. When a patch antenna is used for a required application, for example, communications in a vehicle, the patch antenna needs to have radiation pattern suited for that application.

Prior to providing a specific description of exemplary embodiments of the present disclosure, underlying knowledge forming a basis of the exemplary embodiments will be described. The exemplary embodiments relate to antennas that are mounted on or in vehicles, for example. Such antennas are required to have different radiation pattern depending on communication applications performed in the vehicle. For example, when communications are performed in directions toward surroundings around the vehicle, the antenna needs to have broad-angle radiation pattern. Also, when communications are performed in a traveling direction of the vehicle, the antenna needs to have directivity in that traveling direction. When it is desired to reduce influence of obstacles on radiation emitted from the antenna, the antennas is mounted on the roof of the vehicle. Such antennas to be mounted on the roofs of vehicles are desired to be reduced in size.

One of the techniques to reduce the antenna size is a patch antenna. Patch antennas have a characteristic close to non-directivity. Thus, when a patch antenna is secured on a vehicle roof with a feed element facing upward, emission of radiation increases in a zenith direction as well. Such increase in the undesired emission of radiation in the zenith direction prevents a larger amount of radiation from being emitted in directions toward surroundings around the vehicle or in a traveling direction of the vehicle. In order to reduce the undesired emission of radiation in the zenith direction, a director may be loaded in the patch antenna to tilt a maximum direction of radiation emitted from the antenna. However, a large number of directors are needed to achieve broad-angle radiation pattern, particularly in the directions toward surroundings, resulting in the antenna occupying more space. Therefore, a need exists for a small antenna with radiation pattern suited for communication applications.

In the following description, the terms "parallel" and "orthogonal" are to be understood to include not only "perfectly parallel states" and "perfectly orthogonal states" but also "states which are deviated from parallel or orthogonal states within tolerance". Also, the term "substantially" means being equal, identical, or the same in an approximate range.

Figure 1:
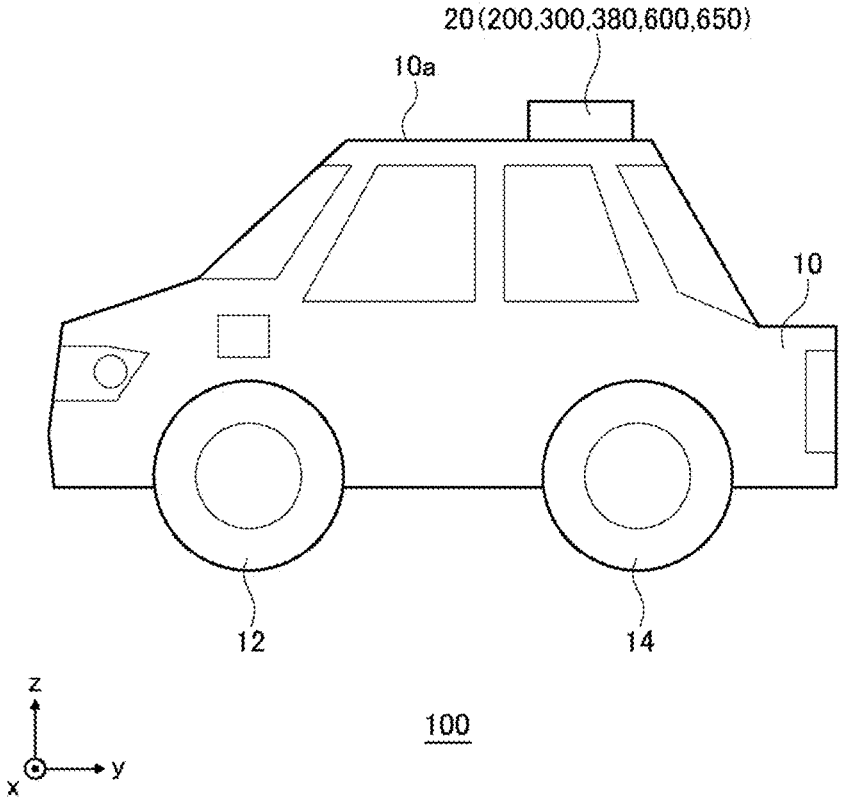
FIG. 1 shows a configuration of a vehicle according to an exemplary embodiment.

FIG. 1 shows a configuration of vehicle 100. An orthogonal coordinate system with x-, y-, and z-axes is defined as shown in FIG. 1. The x-axis indicates a left-right direction of vehicle 100, while the y-axis indicates a forward-rearward direction of vehicle 100. These directions are orthogonal to each other at a bottom face of vehicle 100. The z-axis indicates a height direction of vehicle 100, and is perpendicular to the x-axis and the y-axis. Also, respective positive directions of the x-, y-, and z-axes are defined to be directions of corresponding arrows of FIG. 1, and respective negative directions are defined to be directions opposite to the arrows. For example, the positive direction of the y-axis faces a rear of vehicle 100, and the positive direction of the z-axis faces a zenith. Further, the positive direction of the x-axis may sometimes be referred to as a "right side", the negative direction of the x-axis as a "left side", the positive direction of the y-axis as a "rear side", the negative direction of the y-axis as a "front side", the positive direction of the z-axis as an "upper side", and the negative direction of the z-axis as a "lower side".

Vehicle 100 includes body 10, steerable wheels 12, fixed wheels 14, and antenna 20. Steerable wheels 12 and fixed wheels 14 are disposed under body 10. Steerable wheels 12 are front wheels whose orientation is changed by steering control of a driver. Fixed wheels 14 are rear wheels which are not steered and whose orientation is fixed. Alternatively, steerable wheels 12 may be rear wheels, and fixed wheels 14 may be front wheels. A traveling direction of vehicle 100 is defined to be a direction that is orthogonal to a rotation axis of the fixed wheels 14 and parallel to a road surface where vehicle 100 is placed. Antenna 20 is installed on ceiling portion 10*a* outside vehicle 100. Although antenna 20 has a cover attached thereto for protection against wind and rain, the cover is not described in the following description. Antenna 200, antenna 300, antenna 380, antenna 600, or antenna 650, which will be discussed later, may be set as antenna 20.

Figure 2A:
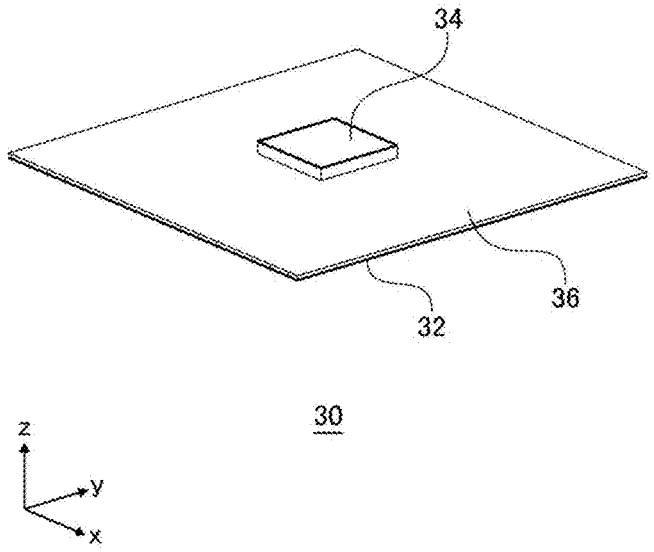
FIG. 2A shows a configuration of an antenna as a comparison target to be compared with the exemplary embodiment.
Figure 2B:
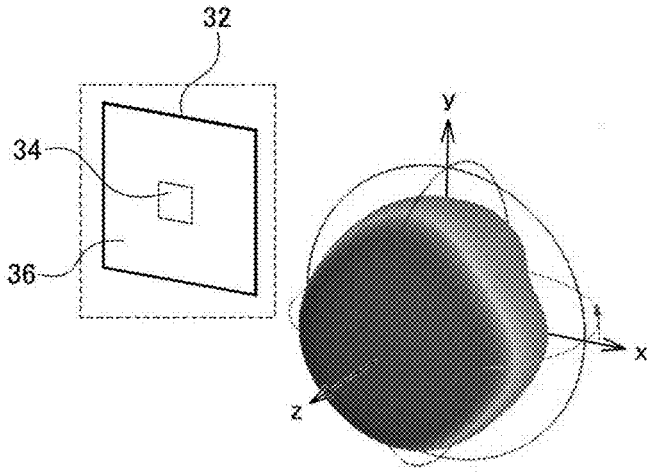
FIG. 2B shows a configuration and a characteristic of the antenna as a comparison target to be compared with the exemplary embodiment.

FIGS. 2A and 2B show a configuration and a characteristic of antenna 30 provided as a comparison target. FIG. 2A is a perspective view showing a configuration of antenna 30. Antenna 30 includes first conductor 32, feed element 34, and dielectric substrate 36. Dielectric substrate 36 is formed into a plate shape and has rectangular surfaces on upper and lower sides (which will be hereinafter referred to as "upper and lower surfaces"). First conductor 32 is disposed on the lower side of dielectric substrate 36. First conductor 32 is a ground plate conductor serving as a ground. First conductor 32 has a surface having a first shape (hereinafter referred to as a "first-shape surface") in an x-y plane when viewed from above, (which may be hereinafter referred to as "in plan view"). Like the lower surface of dielectric substrate 36, the first shape is rectangular, for example, and the first-shape surface corresponds to an upper surface of first conductor 32. The surfaces of first conductor 32 and dielectric substrate 36 are typically planes, but may be slightly curved.

On the other hand, feed element 34 is disposed on the upper surface of dielectric substrate 36, that is, above the first-shape surface of first conductor 32. Feed element 34 is thus disposed along the first-shape surface of first conductor 32 to overlap a central part of the first-shape surface of first conductor 32. Feed element 34 has a surface having a third shape (hereinafter referred to as a "third-shape surface") in plan view. The third-shape surface is rectangular, for example. The third shape of feed element 34 is smaller in area than the first-shape surface of first conductor 32. Antenna 30 is equivalent to a microstrip antenna or a patch antenna.

FIG. 2B shows intensity of radiation emitted from antenna 30 of FIG. 2A. This is obtained by simulation calculation and indicates that the radiation intensity, that is, the amount of radiation, increases in regions of darker color. As can be seen from FIG. 2B, the amount of radiation is large around the positive direction of the z-axis, and a characteristic observed in the x-y plane is close to non-directivity. Thus, when antenna 30 of FIG. 2A is used as antenna 20 of FIG. 1, the amount of radiation increases in the zenith direction of vehicle 100. Considering that communications are not usually performed in the zenith direction of vehicle 100, such radiation in the zenith direction may be undesired. It is therefore desirable to reduce the radiation in the zenith direction and increase the amount of radiation along the x-y plane.

Figure 3A:
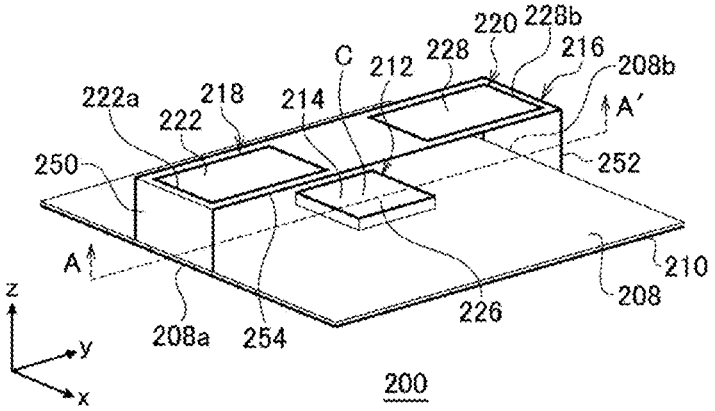
FIG. 3A shows a configuration of an antenna according to the exemplary embodiment.
Figure 3B:
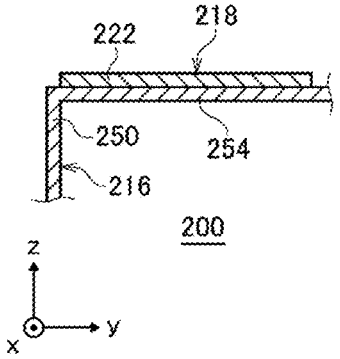
FIG. 3B shows a configuration of the antenna according to the exemplary embodiment.
Figure 3C:
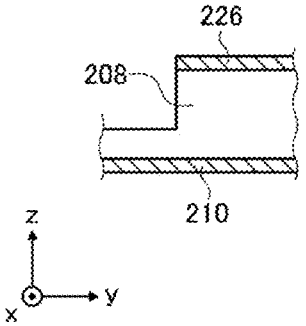
FIG. 3C shows a configuration of the antenna according to the exemplary embodiment.

FIGS. 3A to 3F show configurations of antenna 200 and antenna 300. FIG. 3A is a perspective view showing a configuration of antenna 200. FIG. 3B is a partial cross-sectional view taken along line A-A' of antenna 200 of FIG. 3A in proximity to second conductor 222. FIG. 3C is an enlarged cross-sectional view of a part of antenna 200 of FIG. 3A in proximity to fourth conductor 226. Antenna 200 includes dielectric substrate 208, first conductor 210, feed element 212, supporting member 216, first horizontal director 218, and second horizontal director 220. Feed element 212 includes feed point 214 and fourth conductor 226. Supporting member 216 includes first leg 250, second leg 252, and supporting surface portion 254. First horizontal director 218 includes second conductor 222. Second horizontal director 220 includes fifth conductor 228.

Dielectric substrate 208 and first conductor 210 are identical to dielectric substrate 36 and first conductor 32 of FIG. 2A. Dielectric substrate 208 is disposed on a first-shape surface side of first conductor 210, on which a first-shape surface is formed. In FIG. 3A, although feed element 212 is similar to feed element 34 of FIG. 2A, feed element 212 is illustrated as having fourth conductor 226, which is a third-shape surface, i.e., a surface having the third shape, in plan view. Fourth conductor 226 is disposed on an upwardly projecting part of dielectric substrate 208. Fourth conductor 226 has feed point 214, which is disposed at a predetermined distance from center point C of feed element 212 in plan view in the y-axis direction along the surface of first conductor 210. In FIG. 3A, feed point 214 is disposed at a distance from center point C of the third-shape surface in the negative direction of the y-axis. Alternatively, feed point 214 may be disposed at a distance from center point C in the positive direction of the y-axis. The "center point" of feed element 212 is, for example, a "center of gravity" of the third shape when feed element 212 is seen in plan view.

First leg 250 is formed into a plate shape and extends upwardly from the vicinity of front edge 208*a* of dielectric substrate 208 in a central part of dielectric substrate 208 in the x-axis direction. Second leg 252 is formed into a plate shape and, like first leg 250, extends upwardly from the vicinity of rear edge 208*b* of dielectric substrate 208 in the central part of dielectric substrate 208 in the x-axis direction. Supporting surface portion 254 is formed into a plate shape and extends in the y-axis direction to connect an upper edge of first leg 250 and an upper edge of second leg 252. Supporting surface portion 254 thus extends in a direction in which center point C and feed point 214 of feed element 212 are connected. First leg 250, second leg 252, and supporting surface portion 254 are made of an insulator of resin, for example, and are integrally formed as supporting member 216. A width of supporting member 216 in the x-axis direction is equal to or greater than a width of first horizontal director 218 and second horizontal director 220 in the x-axis direction. First horizontal director 218 and second horizontal director 220 will be discussed below.

First horizontal director 218 is second conductor 222, and corresponds to a parasitic element. Second conductor 222 is formed of copper foil to have a rectangular shape in plan view, for example. Second conductor 222 is smaller in area than the first shape of first conductor 210. Second conductor 222 is secured, with adhesive tape, on an upper side of supporting surface portion 254 at the front side of supporting surface portion 254 as shown in FIG. 3B. Thus, in plan view, i.e., when viewed from a normal direction of first conductor 210, second conductor 222 is disposed to overlap the surface of first conductor 210, and is also displaced from feed element 212 in the direction in which center point C and feed point 214 of feed element 212 are connected, to avoid overlap with center point C of feed element 212. In this configuration, second conductor 222 does not overlap the first-shape surface of first conductor 210 in a perpendicular direction, but may be disposed to overlap the first-shape surface of first conductor 210 in the perpendicular direction. Second conductor 222 is disposed at a distance from feed element 212 with respect to the first-shape surface of first conductor 210. Supporting member 216 made of the insulator mentioned above is disposed at least between first conductor 210 and second conductor 222.

Second horizontal director 220 is fifth conductor 228. Second horizontal director 220 and fifth conductor 228 are similar in configuration to second conductor 222 that is first horizontal director 218. Fifth conductor 228 is secured on the upper side of supporting surface portion 254 at the rear side of supporting surface portion 254. In the other respects, fifth conductor 228 is similar to second conductor 222, and description thereof is thus omitted herein. When antenna 200 is mounted on vehicle 100 as antenna 20 of FIG. 1, second conductor 222 and fifth conductor 228 are disposed at a distance from first conductor 210 with respect to body 10.

Figure 3D:
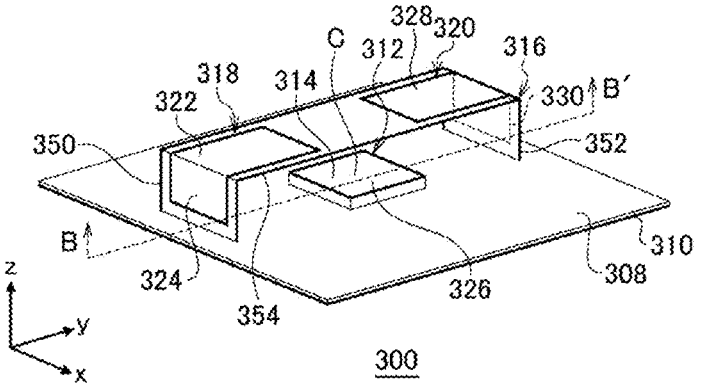
FIG. 3D shows a configuration of an antenna according to the exemplary embodiment.
Figure 3E:
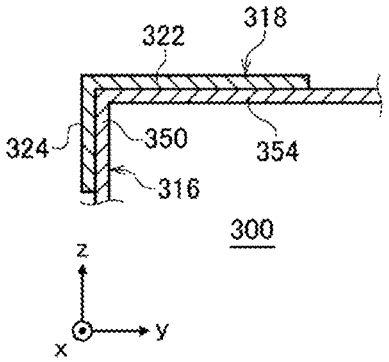
FIG. 3E shows a configuration of the antenna according to the exemplary embodiment.
Figure 3F:
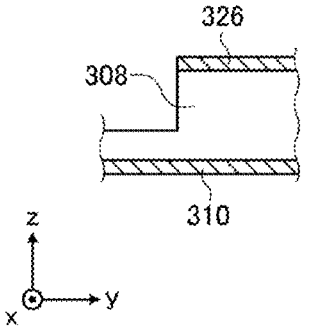
FIG. 3F shows a configuration of the antenna according to the exemplary embodiment.

FIG. 3D is a perspective view showing a configuration of antenna 300. FIG. 3E is a partial cross-sectional view taken along line B-B' of antenna 300 of FIG. 3D in proximity to second conductor 322. FIG. 3F is an enlarged cross-sectional view of a part of antenna 300 of FIG. 3D in proximity to fourth conductor 326. Antenna 300 includes dielectric substrate 308, first conductor 310, feed element 312, supporting member 316, first L-shaped director 318, and second L-shaped director 320. Feed element 312 includes feed point 314 and fourth conductor 326. Supporting member 316 includes first leg 350, second leg 352, and supporting surface portion 354. First L-shaped director 318 includes second conductor 322 and third conductor 324. Second L-shaped director 320 includes fifth conductor 328 and sixth conductor 330.

Dielectric substrate 308 and first conductor 310 are identical to dielectric substrate 208 and first conductor 210 of FIG. 3A. Dielectric substrate 308 is disposed on a first-shape surface side of first conductor 310, on which a first-shape surface is formed. Feed element 312 is similar to feed element 212 of FIG. 3A. In FIG. 3D, feed element 312 is illustrated as having fourth conductor 326, which is a third-shape surface, i.e., a surface having the third shape, in plan view. Fourth conductor 326 is disposed on an upwardly projecting part of dielectric substrate 308. Fourth conductor 326 has feed point 314, which is disposed at a predetermined distance from center point C of feed element 312 in plan view in the y-axis direction along the surface of first conductor 310. Feed point 314 may be disposed at a distance from center point C of the third-shape surface in the negative direction of the y-axis as in FIG. 3A, or may be disposed at a distance from center point C in the positive direction of the y-axis.

First leg 350 is formed into a plate shape and extends upwardly from a region which is located forward of feed element 312 in a central part of dielectric substrate 308 in the x-axis direction. Second leg 352 is formed into a plate shape and, like first leg 350, extends upwardly from a region which is located rearward of feed element 312 in the central part of dielectric substrate 308 in the x-axis direction. Supporting surface portion 354 is formed into a plate shape and extends in the y-axis direction to connect an upper edge of first leg 350 and an upper edge of second leg 352. Thus, supporting surface portion 354 extends in a direction in which center point C and feed point 314 of feed element 312 are connected. As with supporting member 216, first leg 350, second leg 352, and supporting surface portion 354 are formed as supporting member 316. A width of supporting member 316 in the x-axis direction is equal to or greater than a width of first L-shaped director 318 and second L-shaped director 320 in the x-axis direction. First L-shaped director 318 and second L-shaped director 320 will be discussed below.

First L-shaped director 318 includes second conductor 322 and third conductor 324, and corresponds to a parasitic element. In this configuration, second conductor 322 and third conductor 324 may be integral parts of first L-shaped director 318, or may be separate parts of first L-shaped director 318. Second conductor 322 and third conductor 324 are formed of copper foil, for example. Second conductor 322 is a surface having a second shape in plan view, and the surface having the second shape is rectangular, for example. The second shape of second conductor 322 is smaller in area than the first shape of first conductor 310. Second conductor 322 is secured, with adhesive tape, on an upper side of supporting surface portion 354 at the front side of supporting surface portion 354 as shown in FIG. 3E. Thus, in plan view, i.e., when viewed from a normal direction of first conductor 310, second conductor 322 is disposed to overlap the first-shape surface of first conductor 310, and is also displaced from feed element 312 in the direction in which center point C and feed point 314 of feed element 312 are connected, to avoid overlap with center point C of feed element 312. Also in this configuration, second conductor 322 does not overlap the first-shape surface of first conductor 310 in a perpendicular direction, but may be disposed to overlap the first-shape surface of first conductor 310 in the perpendicular direction. Second conductor 322 is disposed at a distance from feed element 312 with respect to the first-shape surface of first conductor 310. Supporting member 316 made of the insulator mentioned above is disposed at least between first conductor 310 and second conductor 322.

Third conductor 324 is rectangular, for example, and is electrically connected to second conductor 322 at least in terms of high frequency. An example configuration of the electrical connection in terms of high frequency is coupling of third conductor 324 and second conductor 322 via a bending portion as can be seen from FIGS. 3D and 3F. Another example configuration is achieved by providing spacing between third conductor 324 and second conductor 322 to such a degree that an electrical connection is made in terms of high frequency. In the former example, first L-shaped director 318 has an L shape formed by the combination of second conductor 322 and third conductor 324.

As shown in FIG. 3E, third conductor 324 is secured, with adhesive tape, on a front surface of first leg 350 to face downward from an upper edge of first leg 350. Thus, third conductor 324 is disposed in such a manner that at least a part of third conductor 324 is closer to first conductor 310 than second conductor 322 is, in a direction perpendicular to the first-shape surface of first conductor 310. Since a lower edge of third conductor 324 is located above a lower edge of first leg 350, supporting member 316 keeps space between at least the part of third conductor 324 and first conductor 310. As a result, third conductor 324 is not electrically connected to first conductor 310 in terms of direct current. On the other hand, at least the part of third conductor 324 is located further forward than a part of second conductor 322 in a direction along the surface of first conductor 310 with respect to feed element 312. The insulator disposed between first conductor 310 and second conductor 322 and between first conductor 310 and second conductor 322 may be glass epoxy or other base material of dielectric substrate 308, or may be air.

Second L-shaped director 320 includes fifth conductor 328 and sixth conductor 330. Second L-shaped director 320, fifth conductor 328, and sixth conductor 330 are similar in configuration to first L-shaped director 318, second conductor 322, and third conductor 324. Fifth conductor 328 is secured on an upper side of supporting surface portion 354 at a rear side of supporting surface portion 354. Sixth conductor 330 is secured on a rear surface of second leg 352. In the other respects, fifth conductor 328 and sixth conductor 330 are similar to second conductor 322 and third conductor 324. Description of fifth conductor 328 and sixth conductor 330 is thus omitted herein. As illustrated in FIG. 1, when antenna 300, like antenna 20, is mounted on vehicle 100, second conductor 322 and fifth conductor 328 are disposed at a distance from first conductor 310 with respect to body 10.

Figure 4A:
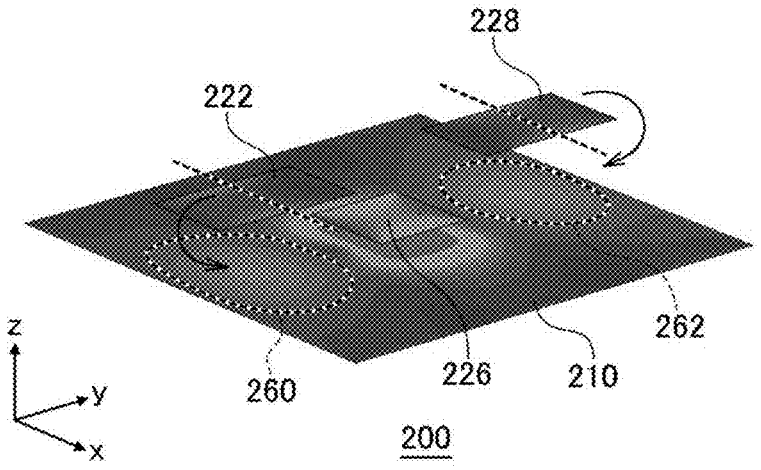
FIG. 4A shows a characteristic of the antenna of FIG. 3A.
Figure 4B:
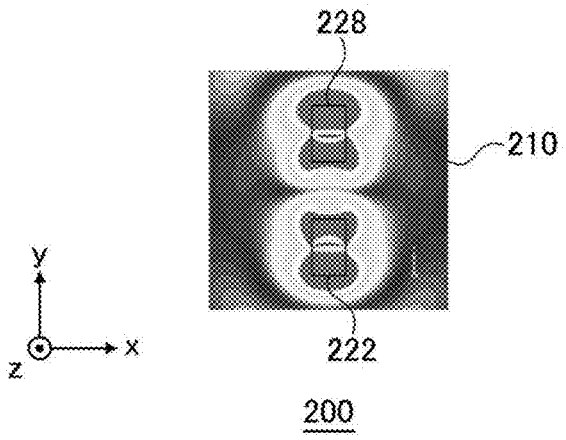
FIG. 4B shows a characteristic of the antenna of FIG. 3A.
Figure 4C:
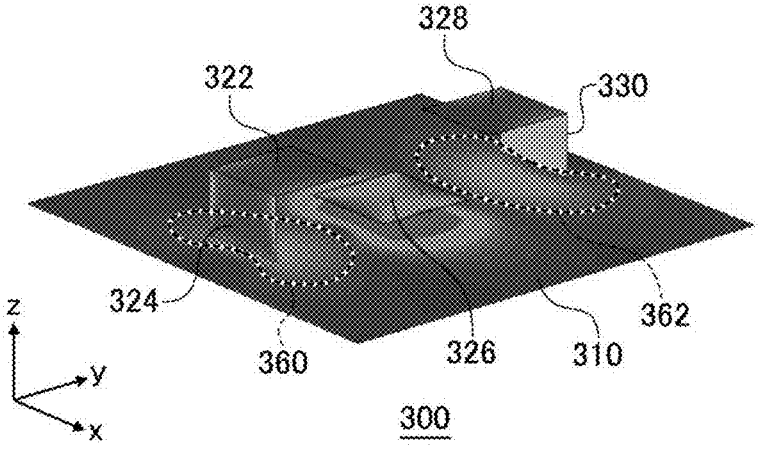
FIG. 4C shows a characteristic of the antenna of FIG. 3D.
Figure 4D:
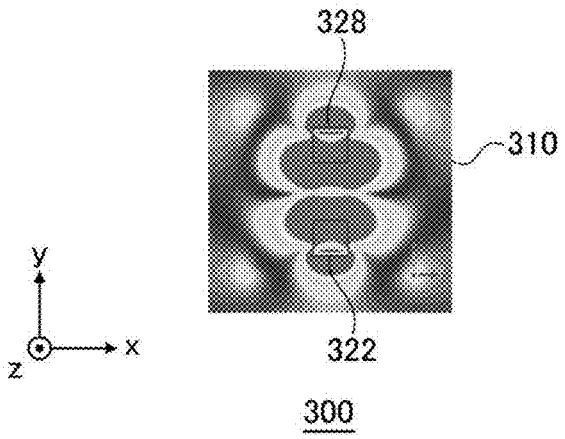
FIG. 4D shows a characteristic of the antenna of FIG. 3D.

FIGS. 4A to 4D show characteristics of antenna 200 and antenna 300. FIGS. 4A and 4B show a characteristic of antenna 200. FIGS. 4C and 4D show a characteristic of antenna 300. In FIGS. 4A to 4D, only the conductors are illustrated for the sake of clarity of explanation. In FIG. 4A, since second conductor 222 is disposed above first conductor 210, first current distribution 260 which is approximately circular in shape occurs on a part of first conductor 210 that includes a region located under second conductor 222. Similarly, second current distribution 262 which is approximately circular in shape occurs on a part of first conductor 210 that includes a region located under fifth conductor 228. FIG. 4B shows radiation propagation in plan view according to first current distribution 260 and second current distribution 262. The radiation travelling in a forward direction from second conductor 222 increases in intensity, and the radiation travelling in a rearward direction from fifth conductor 228 also increases in intensity. That is, the intensity of the radiation traveling in the y-axis direction where second conductor 222 and fifth conductor 228 are disposed increases.

In FIG. 4C, since second conductor 322 is disposed above first conductor 310, first current distribution 360 occurs on a part of first conductor 310 that includes a region located under second conductor 322. In FIG. 4C, the lower part of third conductor 324 is closer to first conductor 310 than second conductor 322 is. This causes capacitive coupling to occur between third conductor 324 and first conductor 310. Consequently, first current distribution 360 deforms in such a manner that current diverts. This results in first current distribution 360 having a shape projecting toward the front side from both the negative and positive sides of the x-axis. Similarly, second current distribution 362 occurs on a part of first conductor 310 that includes a region located under fifth conductor 328. Second current distribution 362 also has a shape projecting toward the rear side from both the negative and positive sides of the x-axis due to capacitive coupling between first conductor 310 and sixth conductor 330.

FIG. 4D shows radiation propagation in plan view according to first current distribution 360 and second current distribution 362. When compared to first current distribution 260 and second current distribution 262, first current distribution 360 and second current distribution 362 have different shapes, and thus regions of strong radiation intensity are different. Specifically, radiation pattern is different. In FIG. 4D, the radiation increases in four directions. One of the four directions lies between the positive x-axis and the positive y-axis. Another one of the four directions lies between the positive x-axis and the negative y-axis. Another one of the four directions lies between the negative x-axis and the negative y-axis. Another one of the four directions lies between the negative x-axis and the positive y-axis.

Figure 5A:
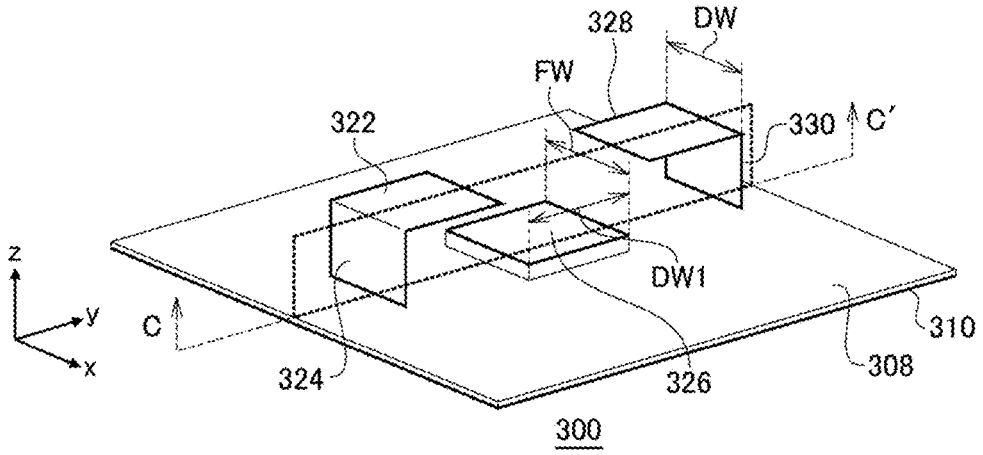
FIG. 5A shows a size of the antenna of FIG. 3D.
Figure 5B:
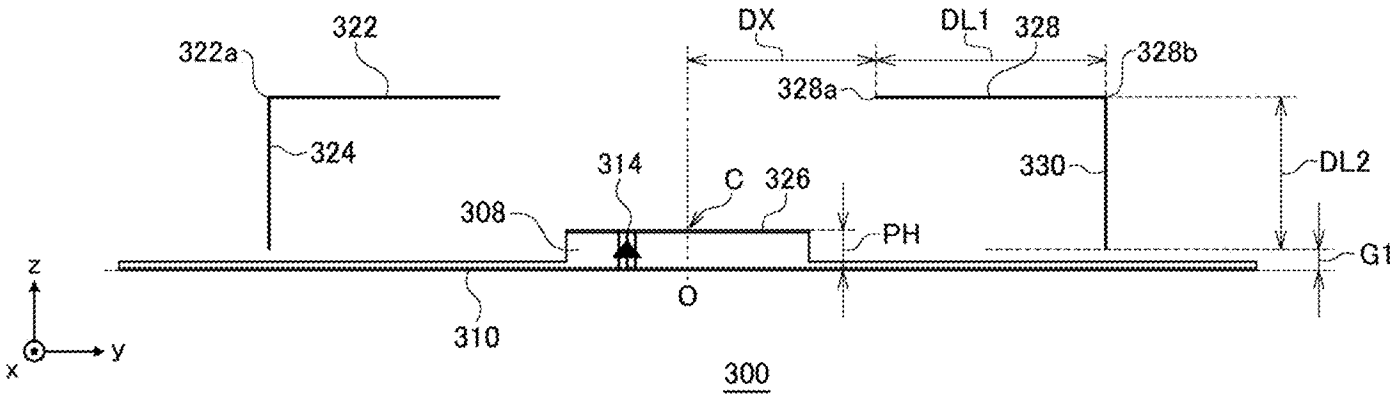
FIG. 5B is a schematic view of the size of the antenna of FIG. 3D.

FIGS. 5A and 5B show a size of antenna 300 having a resonance frequency of 2.45 GHz. FIG. 5A shows dielectric substrate 308, first conductor 310, second conductor 322, third conductor 324, fourth conductor 326, fifth conductor 328, and sixth conductor 330 of antenna 300 of FIG. 3D. As described above, the third shape of fourth conductor 326 is rectangular. A length of one side of the rectangle of the third shape, for example, a width "FW" in the x-axis direction, is substantially 32 mm. In the exemplary embodiment, dielectric substrate 308 has a relative dielectric constant of 4. A side of the rectangle of the third shape in the y-axis direction may be equal in length to "FW". Also, the terms "'FW', i.e., the length of one side of the rectangle of the third shape, is substantially 32 mm when the resonant frequency is 2.45 GHz" as used herein mean that 'FW' may be within 32±10% mm.

A length of one side of the rectangle of the second shape of fifth conductor 328, for example, a width "DW" in the x-axis direction, is substantially 30 mm when antenna 300 has a resonant frequency of 2.45 GHz. The terms "width "DW" is substantially 30 mm when the resonant frequency is 2.45 GHz" as used herein mean that width "DW" may be within 30±10% mm Since widths of second conductor 322, third conductor 324, and sixth conductor 330 in the x-axis direction are also "DW", "DW" may also be considered as the width of first L-shaped director 318 and second L-shaped director 320 in the x-axis direction. Although width "DW" of the second shape of fifth conductor 328 is smaller than width "FW" of the third shape of fourth conductor 326 in the exemplary embodiment, "DW" may be greater than or equal to "FW".

FIG. 5B is a schematic view of a cross-section taken along line C-C' of antenna 300 of FIG. 5A. In FIG. 5B, height "PH" of fourth conductor 326 from first conductor 310 is substantially 5 mm when antenna 300 has a resonant frequency of 2.45 GHz. The terms "height "PH" is substantially 5 mm when the resonant frequency is 2.45 GHz" as used herein mean that height "PH" may be within 5±10% mm. When antenna 300 has a resonant frequency of 2.45 GHz, distance "DX" between center point C of fourth conductor 326 and front edge 328*a* of fifth conductor 328 is substantially 25 mm. The terms "distance "DX" is substantially 25 mm when the resonant frequency is 2.45 GHz" as used herein mean that distance "DX" may be within 25±10% mm. Length "DL1" of fifth conductor 328 in the y-axis direction is substantially 30 mm when antenna 300 has a resonant frequency of 2.45 GHz. The terms "length "DL1" is substantially 30 mm when the resonant frequency is 2.45 GHz" as used herein mean that length "DL1" is within 30±10% mm. When the second shape of fifth conductor 328 is square in plan view, "DL1" is equal to "DW".

Length "DL2" of sixth conductor 330 in the z-axis direction is substantially 20 mm when antenna 300 has a resonant frequency of 2.45 GHz. Gap "G1" between at least a part, for example, a lower edge, of sixth conductor 330 and first conductor 310 is substantially greater than 0 mm and not more than 2.5 mm when antenna 300 has a resonant frequency of 2.45 GHz. Gap "G1" is 2.5 mm, for example. Hence, the gap is very small and causes capacitive coupling to increase as mentioned above. For the distances, for example, dimensions that are within 10 percent above or below the dimensions mentioned above are also applicable. Also, second conductor 322 and third conductor 324 are similar to fifth conductor 328 and sixth conductor 330.

According to these values, the length between front edge 322*a* of second conductor 322 and rear edge 328*b* of fifth conductor 328 is 110 mm. On the other hand, since the length of second conductor 222 of antenna 200 in the y-axis direction is 50 mm, the length between front edge 222*a* of second conductor 222 and rear edge 228*b* of fifth conductor 228 is 150 mm. The height between first conductor 210 and second conductor 222 is the same as the height between first conductor 310 and second conductor 322. Consequently, a volume of a portion surrounded by supporting member 316 is 25% smaller than a volume of a portion surrounded by supporting member 216. Hence, antenna 300 is smaller in size than antenna 200.

Figure 6A:
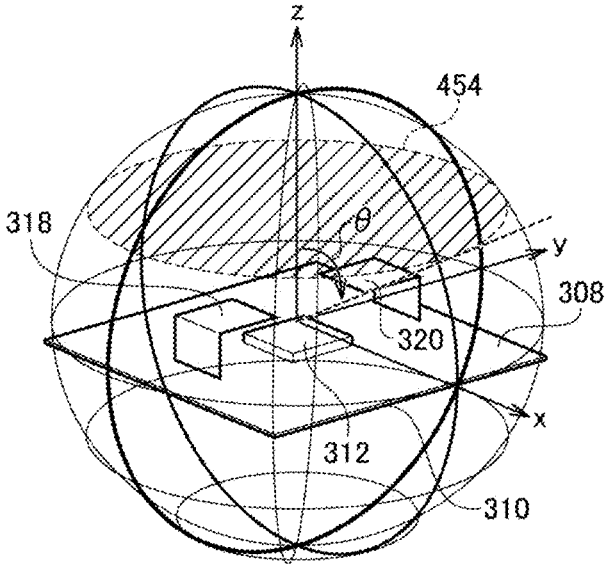
FIG. 6A shows an angle according to the exemplary embodiment.
Figure 6B:
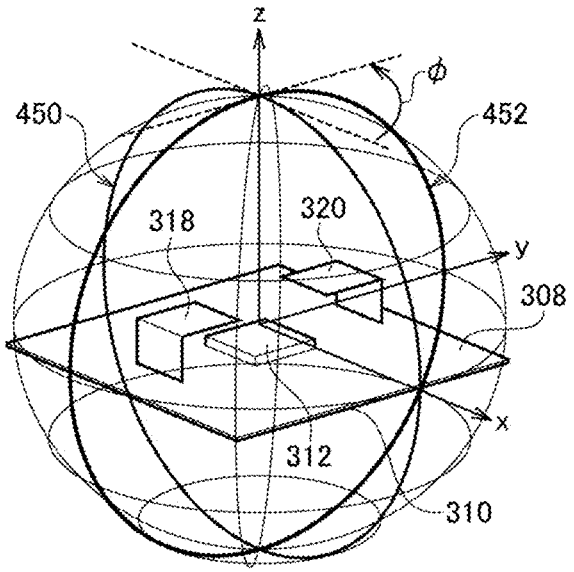
FIG. 6B shows an angle according to the exemplary embodiment.

FIGS. 6A and 6B show angles according to the exemplary embodiment. FIG. 6A shows angle θ in the above-described orthogonal coordinate system. FIG. 6B shows angle ϕ in the orthogonal coordinate system. Angle θ and angle ϕ are defined in a spherical coordinate system. Angle θ is defined as an angle formed by the z-axis and a moving radius, and angle ϕ is defined as an angle formed by the x-axis and a projection of the moving radius on the x-y plane. FIG. 6A shows θ-surface 454 corresponding to angle θ. FIG. 6B shows ϕ=0° surface 450 corresponding to angle ϕ=0°, and ϕ=90° surface 452 corresponding to angle ϕ=90°. Angle ϕ=90° faces the rear side described above, and angle ϕ=270° faces the front side described above.

Figure 7A:
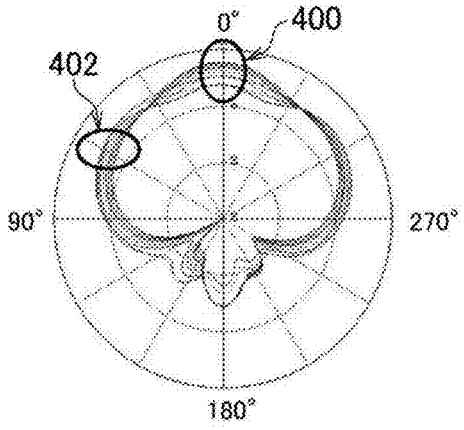
FIG. 7A shows a characteristic when gap G1 of FIG. 5B is changed.
Figure 7B:
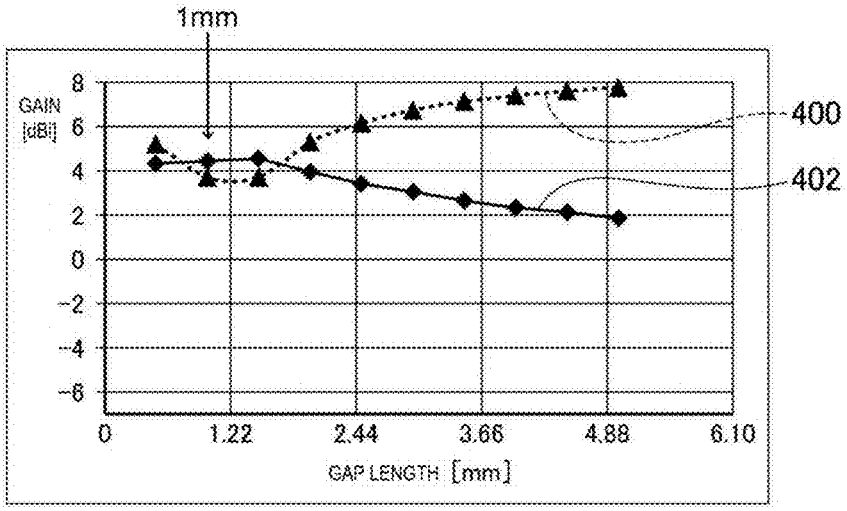
FIG. 7B shows a characteristic when gap G1 of FIG. 5B is changed.

With the angles defined above, the following describes characteristics of antenna 300 observed when parameters are changed. FIGS. 7A to 7D show characteristics corresponding to changes in gap G1. FIG. 7A shows a radiation pattern of antenna 300 when gap G1 is changed in an angle ϕ=45° surface. FIG. 7A focuses on θ=0° direction 400 and θ=60° direction 402. FIG. 7B shows gain when a gap length [mm] is changed in θ=0° direction 400 and in θ=60° direction 402. It can be seen from FIG. 7B that the effect of achieving broader-angle radiation pattern in the angle ϕ=45° surface becomes maximal when gap G1 is 1 mm.

Figure 7C:
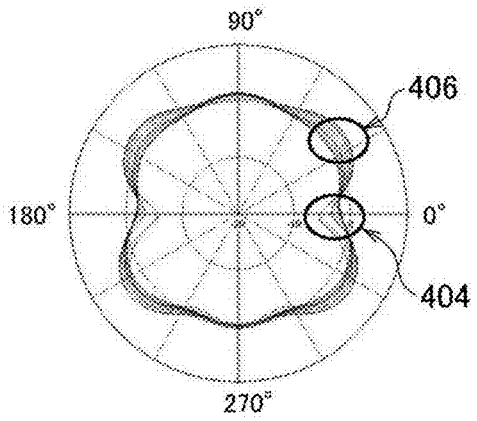
FIG. 7C shows a characteristic when gap G1 of FIG. 5B is changed.
Figure 7D:
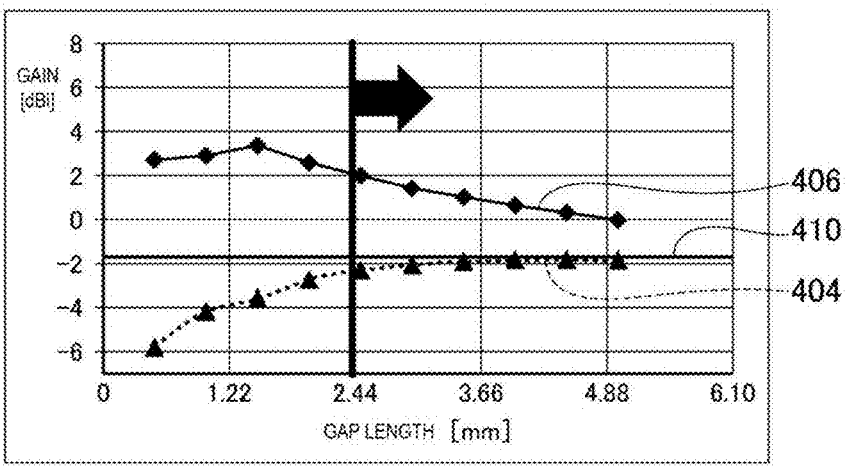
FIG. 7D shows a characteristic when gap G1 of FIG. 5B is changed.

FIG. 7C shows a radiation pattern of antenna 300 when gap G1 is changed in an angle θ=75° surface. FIG. 7C focuses on ϕ=0° direction 404 and ϕ=45° direction 406. FIG. 7D shows gain when the gap length [mm] is changed in ϕ=0° direction 404 and in ϕ=45° direction 406. As a comparison target, patch antenna unit 410 is shown. Patch antenna unit 410 is equivalent to antenna 30. It can be said that when gap G1>2.5 mm, the radiation pattern in ϕ=0° direction 404 asymptotically approaches the radiation pattern of patch antenna unit 410.

Figure 8A:
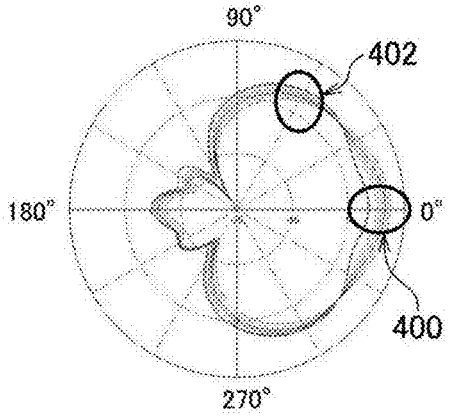
FIG. 8A shows a characteristic when L-shaped director width DW of FIG. 5A is changed.
Figure 8B:
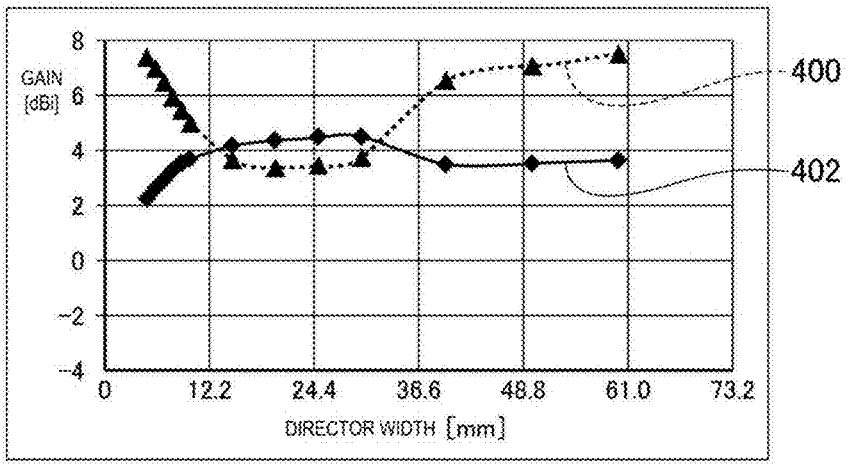
FIG. 8B shows a characteristic when L-shaped director width DW of FIG. 5A is changed.

FIGS. 8A to 8D show characteristics observed when L-shaped director width DW is changed. FIG. 8A shows a radiation pattern of antenna 300 when L-shaped director width DW is changed in the angle ϕ=45° surface. FIG. 8A focuses on θ=0° direction 400 and θ=60° direction 402. FIG. 8B shows gain when L-shaped director width DW [mm] is changed in θ=0° direction 400 and in θ=60° direction 402. It can be seen from FIG. 8B that the effect of achieving broader-angle radiation pattern in the angle ϕ=45° surface becomes maximal when 15 mm≤DW≤30 mm.

Figure 8C:
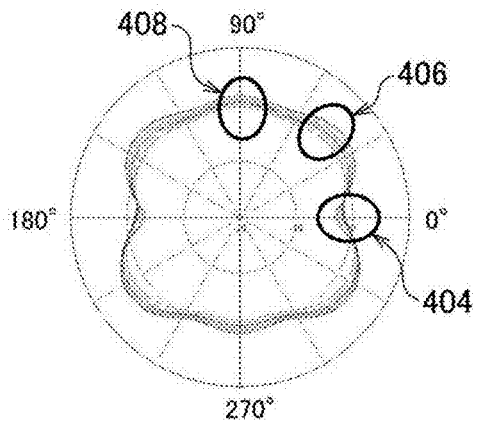
FIG. 8C shows a characteristic when L-shaped director width DW of FIG. 5A is changed.
Figure 8D:
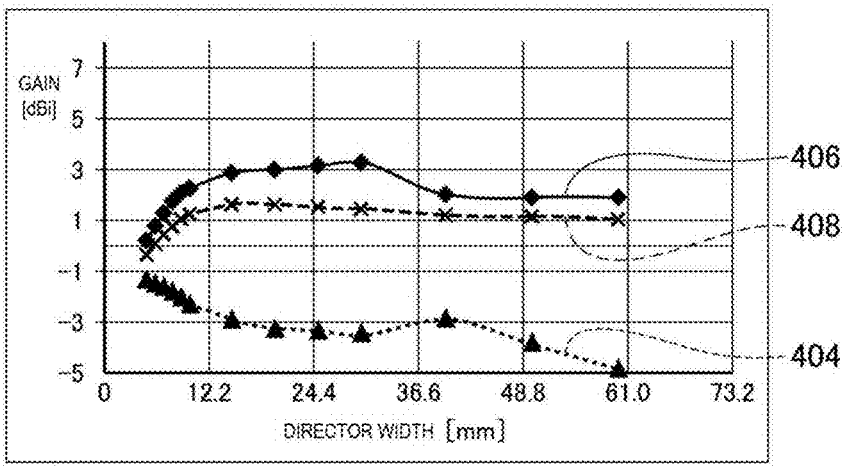
FIG. 8D shows a characteristic when L-shaped director width DW of FIG. 5A is changed.

FIG. 8C shows a radiation pattern of antenna 300 when L-shaped director width DW is changed in the angle θ=75° surface. FIG. 8C focuses on ϕ=0° direction 404, ϕ=45° direction 406, and ϕ=90° direction 408. FIG. 8D shows gain when L-shaped director width DW [mm] is changed in ϕ=0° direction 404, in ϕ=45° direction 406, and in ϕ=90° direction 408. It can be seen from FIG. 8D that the effect of achieving broader-angle radiation pattern in ϕ=45° direction 406 and ϕ=90° direction 408 becomes maximal when 15 mm≤DW≤30 mm.

Figure 9A:
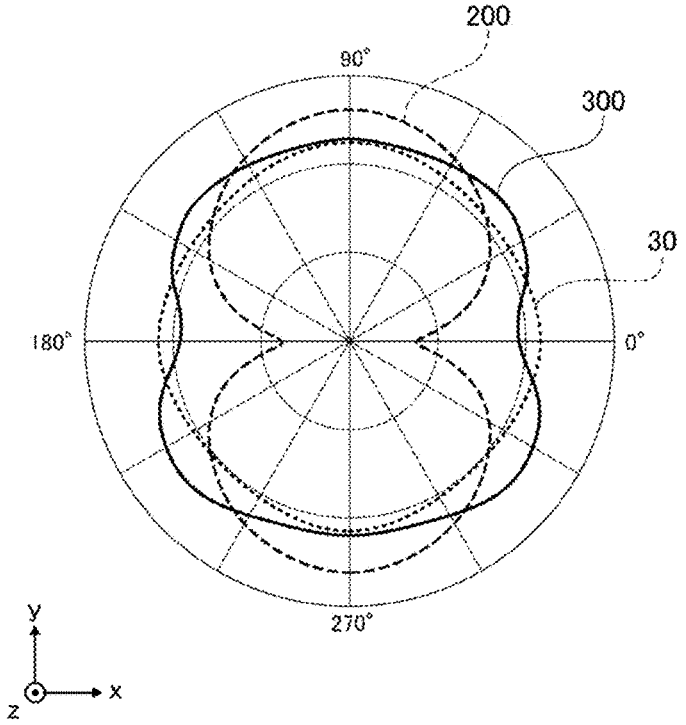
FIG. 9A shows characteristics of the antennas of FIGS. 2A, 3A, and 3D.
Figure 9B:
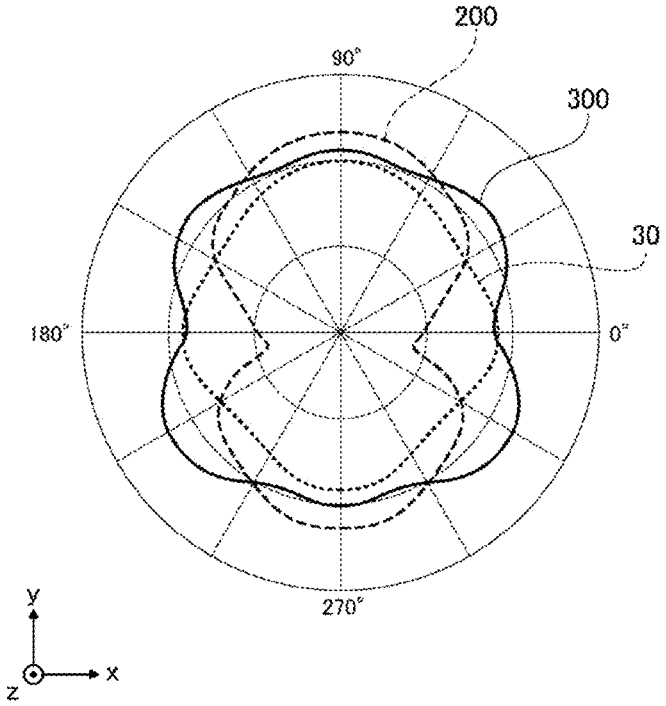
FIG. 9B shows characteristics of the antennas of FIGS. 2A, 3A, and 3D.

FIGS. 9A and 9B show characteristics of antenna 30, antenna 200, and antenna 300. More specifically, FIG. 9A shows radiation patterns of antenna 30, antenna 200, and antenna 300 in a θ=60° surface. FIG. 9B shows radiation patterns of antenna 30, antenna 200, and antenna 300 in a θ=75° surface. Antenna 30 has a radiation pattern close to non-directivity. In antenna 200, radiation intensity increases in a ϕ=90° direction and in a ϕ=270° direction, that is, in the forward direction and in the rearward direction. On the contrary, the radiation intensity decreases in a ϕ=0° direction and in a ϕ=180° direction. In other words, antenna 200 has a radiation pattern directed in the forward and rearward directions. In antenna 300, radiation intensity also increases in a ϕ=45° direction, in a ϕ=135° direction, in a ϕ=225° direction, and in a ϕ=315° direction. In other words, antenna 300 has a broader-angle radiation pattern.

As compared to the radiation pattern of antenna 30, the radiation pattern of antenna 200 is enlarged by 52% in the θ=60° surface and by 33% in the θ=75° surface. Also, the radiation pattern of antenna 300 is enlarged by 82% in the θ=60° surface and by 93% in the θ=75° surface as compared to the radiation pattern of antenna 30.

Figure 10A:
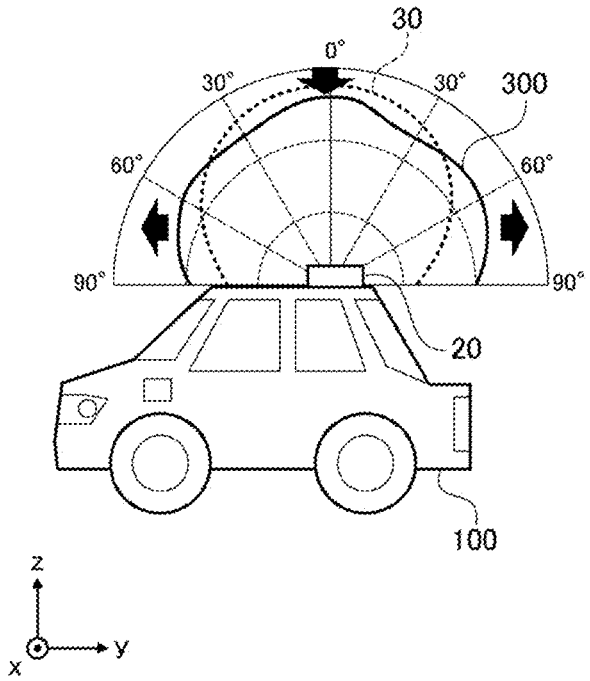
FIG. 10A shows characteristics of antennas mounted on the vehicle of FIG. 1.
Figure 10B:
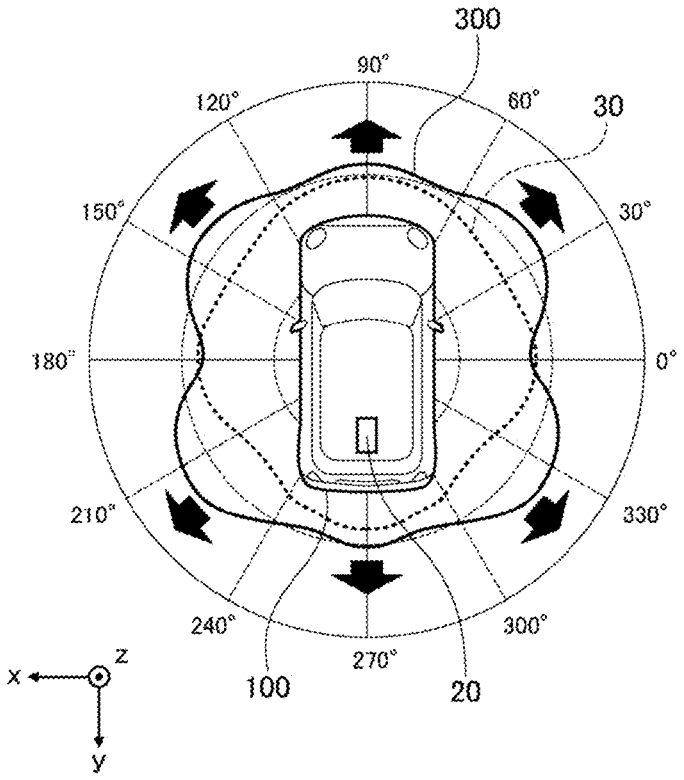
FIG. 10B shows characteristics of the antennas mounted on the vehicle of FIG. 1.

FIGS. 10A and 10B show characteristics of antenna 20 mounted on vehicle 100. FIG. 10A shows vehicle 100 viewed from the same direction as in FIG. 1. FIG. 10B shows vehicle 100 in plan view. In FIG. 10A, when antenna 30 is used as antenna 20, antenna 30 emits unnecessary radiation in the zenith direction as described above. On the other hand, when antenna 300 is used as antenna 20, antenna 300 emits less radiation in the zenith direction and more radiation in the forward and rearward directions than antenna 30. In FIG. 10B, as in FIG. 9B, a radiation pattern of antenna 300 used as antenna 20 shows that higher intensity is obtained for all directions toward surroundings as compared to the case where antenna 30 is used as antenna 20. When antenna 200 is used as antenna 20, radiation intensity increases in the forward and rearward directions as in FIG. 9B.

For antenna 300, height "PH" of fourth conductor 326 from first conductor 310 is substantially 5 mm in the foregoing description as shown in FIG. 5B. Also, gap "G1" between at least a part, for example, the lower edge, of sixth conductor 330 and first conductor 310 is substantially greater than 0 mm and not more than 2.5 mm, and is fixed at 2.5 mm, for example. Gap "G1" is similarly defined between at least a part, for example, a lower edge, of third conductor 324 and first conductor 310. The following describes changes in a characteristic of antenna 300 when gap "G1" is changed in size. Note that when "PH" is referred to as a "first distance", "G1" is referred to as a "second distance".

Figure 11A:
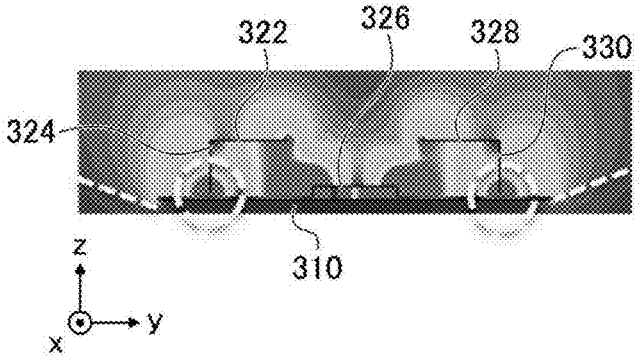
FIG. 11A shows another characteristic of the antenna of FIG. 3D.
Figure 11B:
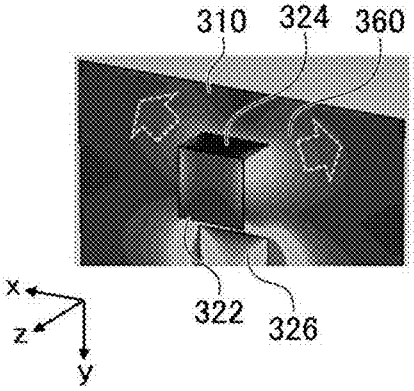
FIG. 11B shows another characteristic of the antenna of FIG. 3D.
Figure 11C:
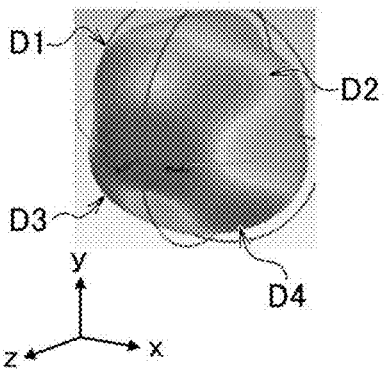
FIG. 11C shows another characteristic of the antenna of FIG. 3D.
Figure 11D:
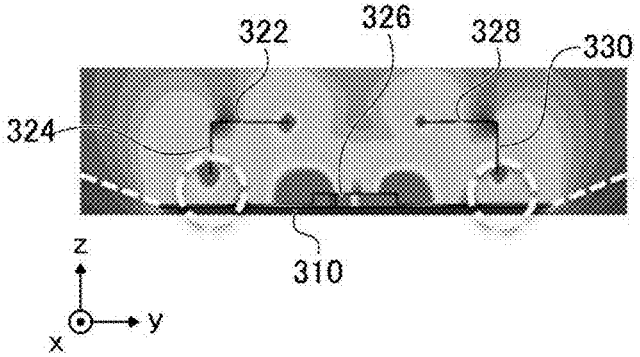
FIG. 11D shows another characteristic of the antenna of FIG. 3D.
Figure 11E:
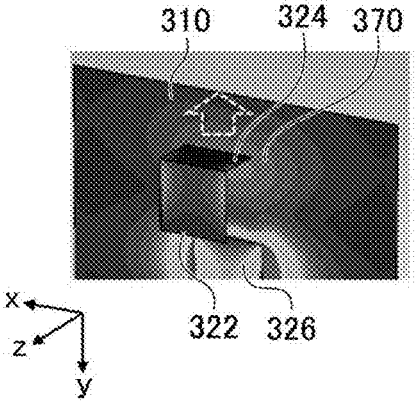
FIG. 11E shows another characteristic of the antenna of FIG. 3D.
Figure 11F:
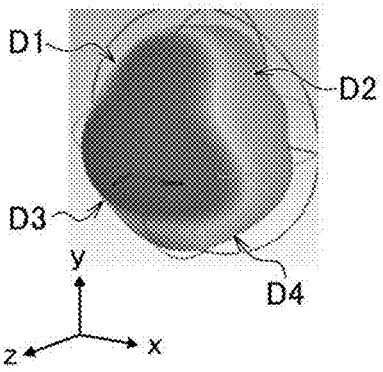
FIG. 11F shows another characteristic of the antenna of FIG. 3D.

FIGS. 11A to 11F show other characteristics of antenna 300. FIGS. 11A to 11C show characteristics of antenna 300 in a case in which "G1" is less than twice "PH". FIGS. 11D to 11F show characteristics of antenna 300 in a case in which "G1" is equal to or more than twice "PH". The former case includes the aforementioned case in which "PH" is substantially 5 mm, and "G1" is substantially greater than 0 mm and not more than 2.5 mm, that is, "G1" is smaller than "PH". In the following description, the configuration of antenna 300 of FIGS. 11A to 11C is referred to as a "close configuration", and the configuration of antenna 300 of FIGS. 11D to 11F is referred to as a "distant configuration". The close configuration and the distant configuration differ only in the size of G1, and are the same in the other respects.

FIG. 11A shows electric field distribution of antenna 300 having the close configuration. FIG. 11A is a cross-sectional view taken in the same direction as FIG. 5B. This is obtained by simulation calculation, and shows that the electric field intensity increases as the color darkens. As shown in FIG. 11A, the color darkens in a region between the lower edge of third conductor 324 and first conductor 310. This is because the lower edge of third conductor 324 is close to first conductor 310, and thus capacitive coupling occurs between the lower edge of third conductor 324 and first conductor 310. The same holds true for a region between the lower edge of sixth conductor 330 and first conductor 310. Also, such capacitive coupling in these regions causes reradiation in a direction along first conductor 310.

FIG. 11B shows current distribution of antenna 300 having the close configuration. FIG. 11B is a perspective view when first conductor 310 is viewed from above, and corresponds to a case when the characteristic of FIG. 4B is seen from a different direction. As described above, due to the capacitive coupling between third conductor 324 and first conductor 310, first current distribution 360 deforms and diverts to bypass third conductor 324. This results in first current distribution 360 having a shape projecting toward the front side from both the negative and positive sides of the x-axis. Thus, ground current in first conductor 310 branches in the area where the capacitive coupling occurs between first conductor 310 and third conductor 324, and flows in diagonally forward-right and forward-left directions.

FIG. 11C, as in FIG. 2B, shows intensity of radiation emitted from antenna 300 having the close configuration. The capacitive coupling shown FIG. 11A causes the ground current to branch and flow diagonally as shown in FIG. 11B. The radiation intensity increases in the directions in which the ground current flows. The ground current flows in directions D1 to D4. This corresponds to a phenomenon in which the amount of radiation increases in the direction sandwiched by the x-axis and y-axis in the x-y plane.

FIG. 11D, as in FIG. 11A, shows electric field distribution of antenna 300 having the distant configuration. As shown in FIG. 11D, the color does not darken in a region between the lower edge of third conductor 324 and first conductor 310. This is because the lower edge of third conductor 324 is spaced apart from first conductor 310, and no capacitive coupling occurs between the lower edge of third conductor 324 and first conductor 310. This is true for a region between the lower edge of sixth conductor 330 and first conductor 310.

FIG. 11E, as in FIG. 11B, shows current distribution of antenna 300 having the distant configuration. Since no capacitive coupling occurs between third conductor 324 and first conductor 310, first current distribution 370 is approximately circular in shape. Thus, ground current in first conductor 310 flows toward third conductor 324, that is, in the negative direction of the y-axis.

FIG. 11F, as in FIG. 11C, shows intensity of radiation emitted from antenna 300 having the distant configuration. Since no capacitive coupling occurs, the ground current does not branch to flow diagonally. Accordingly, the radiation intensity decreases in the directions D1 to D4 in the x-y plane. This corresponds to a phenomenon in which the amount of radiation decreases in the direction sandwiched by the x-axis and y-axis in the x-y plane.

Figure 12A:
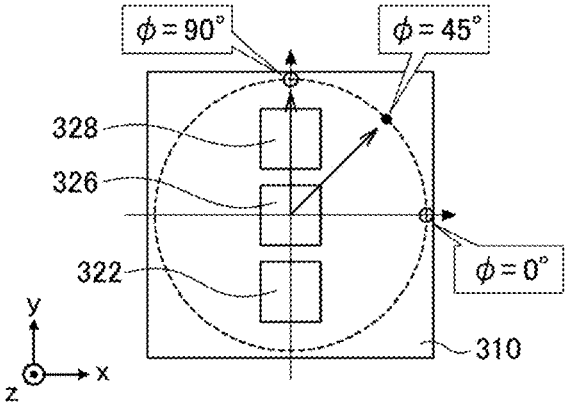
FIG. 12A shows a directivity characteristic of the antenna of FIG. 3D when capacitive coupling is changed.
Figure 12B:
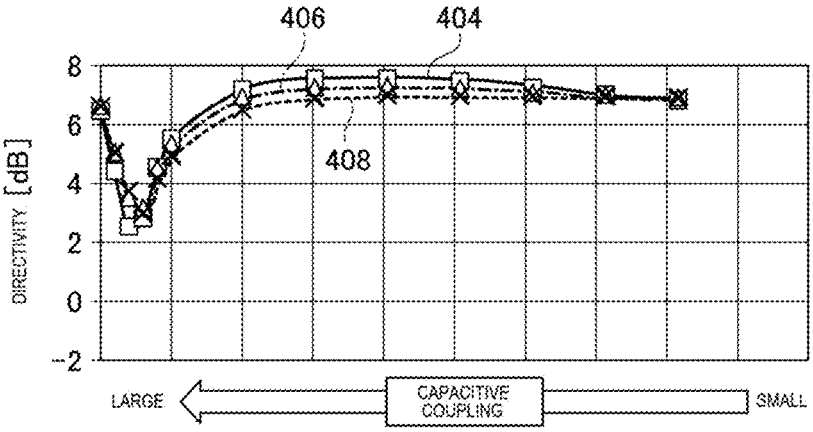
FIG. 12B shows a directivity characteristic of the antenna of FIG. 3D when capacitive coupling is changed.
Figure 12C:
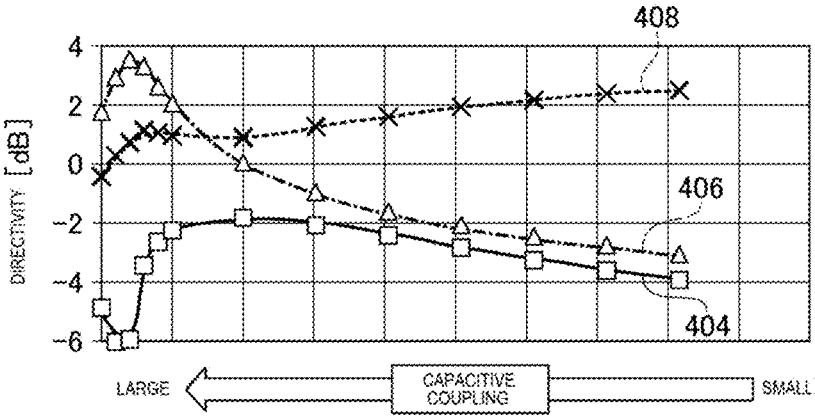
FIG. 12C shows a directivity characteristic of the antenna of FIG. 3D when capacitive coupling is changed.

FIGS. 12A to 12C show directivity characteristics of antenna 300 when capacitive coupling is changed. FIG. 12A shows definition of angle $\phi$ which is used to explain the directivity characteristics. The definition of angle $\phi$ is the same as in FIG. 6B. The positive direction of the x-axis indicates angle $\phi=0°$, while the positive direction of the y-axis indicates angle $\phi=90°$. FIG. 12B shows relationship between the capacitive coupling and the directivity at $\theta=15°$. The abscissa indicates the capacitive coupling, which decreases with increasing proximity to the right side. A small-capacitive-coupling area corresponds to the distant configuration, while a large-capacitive-coupling area corresponds to the close configuration. Also, $\phi=0°$ direction 404, $\phi=45°$ direction 406, and $\phi=90°$ direction 408 indicate various values of angle $\phi$. As shown in FIG. 12B, as the capacitive coupling decreases, the directivity in $\phi=0°$ direction 404 to $\phi=90°$ direction 408 increases. This indicates that the directivity in the zenith direction increases.

FIG. 12C shows relationship between the capacitive coupling and the directivity at $\theta=75°$. As shown in FIG. 12C, when the capacitive coupling is large, the directivity in $\phi=45°$ direction 406 increases. More specifically, as the capacitive coupling decreases from a maximum level, the directivity in $\phi=45°$ direction 406 increases. After reaching a maximum, the directivity in $\phi=45°$ direction 406 decreases as the capacitive coupling decreases. This corresponds to a phenomenon in which the radiation intensity increases in directions D1 to D4 as shown in FIG. 11C. On the other hand, when the capacitive coupling is large, the directivity in $\phi=0°$ direction 404 decreases. More specifically, as the capacitive coupling decreases from a maximum level, the directivity in $\phi=0°$ direction 404 decreases. After reaching a minimum, the directivity in $\phi=0°$ direction 404 increases as the capacitive coupling decreases.

Figure 13A:
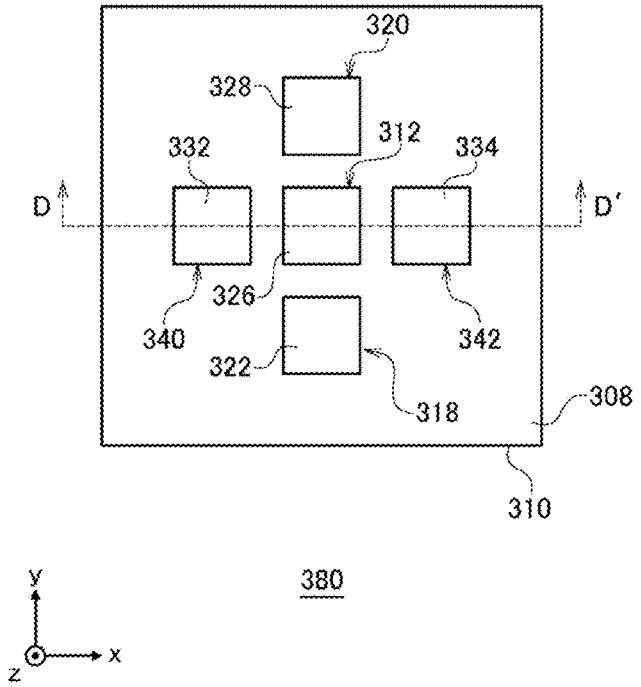
FIG. 13A shows a configuration of an antenna according to a modified example.
Figure 13B:
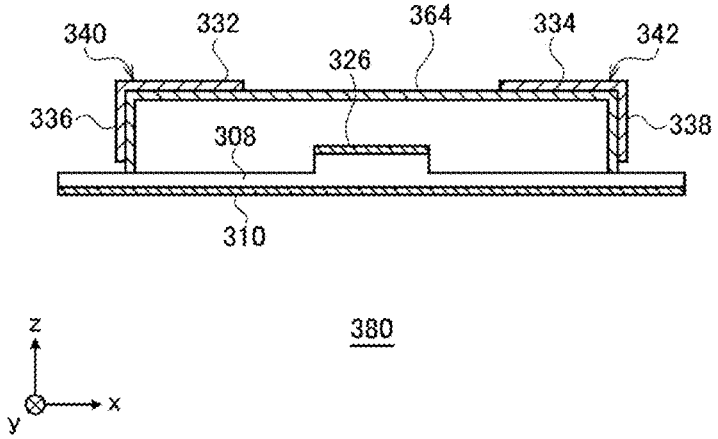
FIG. 13B shows a configuration of the antenna according to the modified example.

The following describes modified examples of antenna 300 set forth above. FIGS. 13A and 13B show a configuration of antenna 380 according to a modified example. FIG. 13A is a top view of antenna 380. FIG. 13B is a cross-sectional view taken along line D-D' of antenna 380 of FIG. 13A. In antenna 380, dielectric substrate 308, first conductor 310, feed element 312, first L-shaped director 318, and second L-shaped director 320 are identical to those of antenna 300. Antenna 380 further includes third L-shaped director 340, fourth L-shaped director 342, and supporting member 364. First L-shaped director 318 and second L-shaped director 320 are arranged in the y-axis direction with feed element 312 located at a midpoint. On the other hand, third L-shaped director 340 and fourth L-shaped director 342 are arranged in the x-axis direction with feed element 312 located at a midpoint.

Third L-shaped director 340 includes seventh conductor 332 and ninth conductor 336, while fourth L-shaped director 342 includes eighth conductor 334 and tenth conductor 338. Supporting member 364 is similar in configuration to supporting member 316, and extends in the x-axis direction. Seventh conductor 332 and ninth conductor 336 are similar to second conductor 322 and third conductor 324 of FIGS. 3D to 3F. Eighth conductor 334 and tenth conductor 338 are similar to fifth conductor 328 and sixth conductor 330 of FIG. 3D. Antenna 380 may be installed on ceiling portion 10*a* outside vehicle 100 as antenna 20 as illustrated in FIG. 1.

Figure 14A:
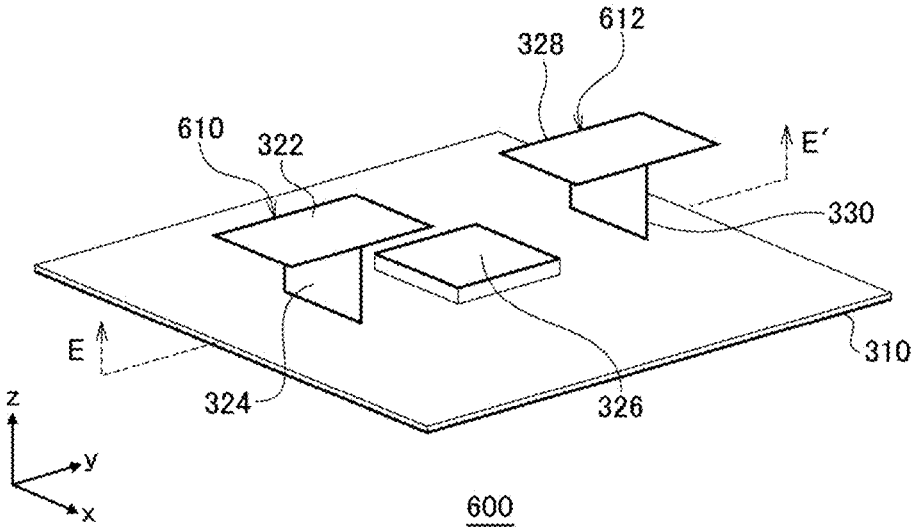
FIG. 14A shows a configuration of an antenna according to another modified example.
Figure 14B:
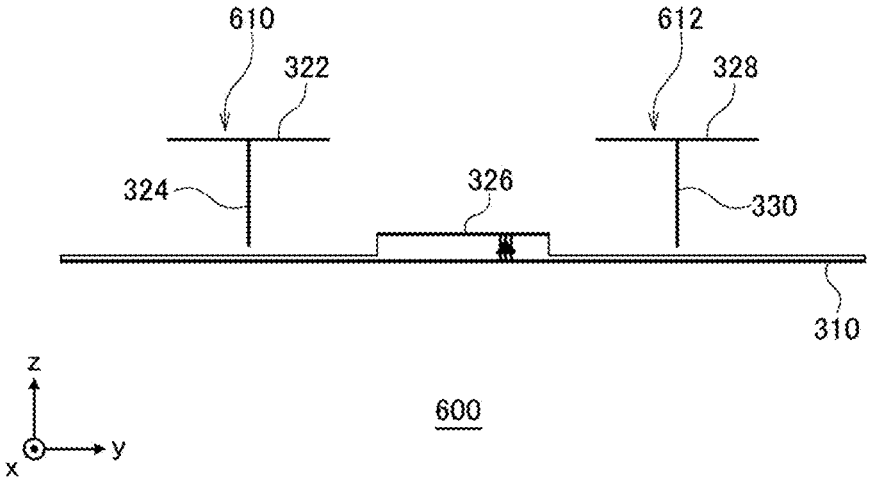
FIG. 14B shows a configuration of the antenna according to the other modified example.

FIGS. 14A and 14B show a configuration of antenna 600 according to another modified example. FIG. 14A is a perspective view of antenna 600. FIG. 14B is a schematic view of a cross-section taken along line E-E' of antenna 600 of FIG. 14A. In antenna 600, first conductor 310 and fourth conductor 326 are identical to those of antenna 300. Antenna 600 includes first T-shaped director 610 and second T-shaped director 612 in place of first L-shaped director 318 and second L-shaped director 320 of antenna 300. First T-shaped director 610, like first L-shaped director 318, includes second conductor 322 and third conductor 324. Second T-shaped director 612, like second L-shaped director 320, includes fifth conductor 328 and sixth conductor 330.

However, third conductor 324 is connected to a central part of second conductor 322 in the y-axis direction, while sixth conductor 330 is connected to a central part of fifth conductor 328 in the y-axis direction. First T-shaped director 610 has a T shape in the z-y plane. Second T-shaped director 612 also has a T shape in the z-y plane. Relationship between a lower edge of third conductor 324 and first conductor 310, and relationship between a lower edge of sixth conductor 330 and first conductor 310 are the same as described above.

Figure 15A:
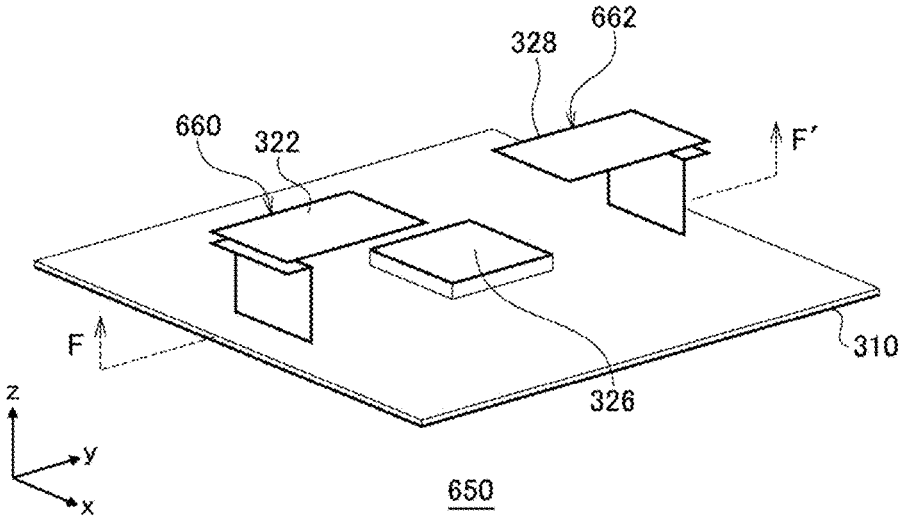
FIG. 15A is a schematic view of a configuration of an antenna according to still another modified example.
Figure 15B:
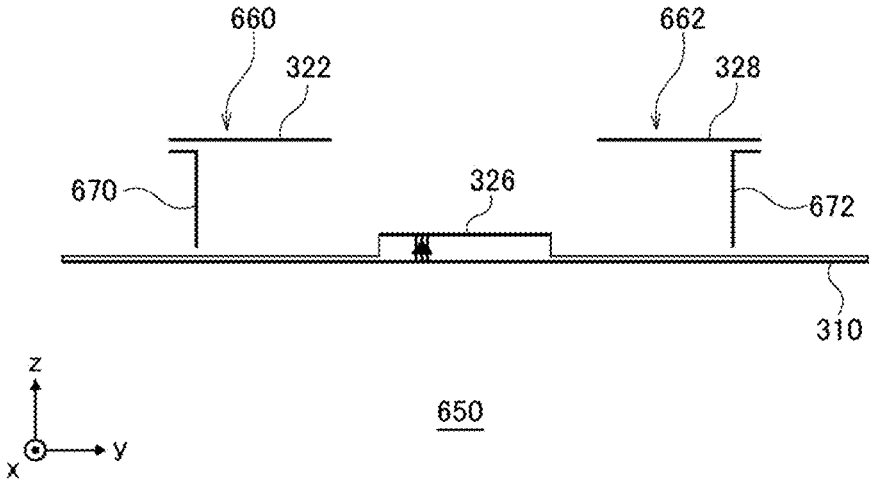
FIG. 15B is a schematic view of a configuration of the antenna according to the still another modified example.

FIGS. 15A and 15B show a configuration of antenna 650 according to still another modified example. FIG. 15A is a perspective view of antenna 650. FIG. 15B is a schematic view of a cross-section taken along line F-F' of antenna 650 of FIG. 15A. In antenna 650, first conductor 310 and fourth conductor 326 are identical to those of antenna 300. Antenna 650 includes first T-shaped director 660 and second T-shaped director 662 in place of first L-shaped director 318 and second L-shaped director 320 of antenna 300. First T-shaped director 660 includes second conductor 322 and first L-shaped conductor 670. Second conductor 322 is the same as described above. On the other hand, first L-shaped conductor 670 includes a rectangular surface that extends in the z-x plane like third conductor 324, and another rectangular surface that is disposed to extend from an upper edge of the rectangular surface along second conductor 322. Due to capacitance coupling, second conductor 322 is electrically connected to first L-shaped conductor 670 in terms of high frequency. Second T-shaped director 662 includes fifth conductor 328 and second L-shaped conductor 672, and is similar in configuration to first T-shaped director 660. Relationship between a lower edge of first L-shaped conductor 670 and first conductor 310, and relationship between a lower edge of second L-shaped conductor 672 and first conductor 310 are the same as described above.

Figure 16:
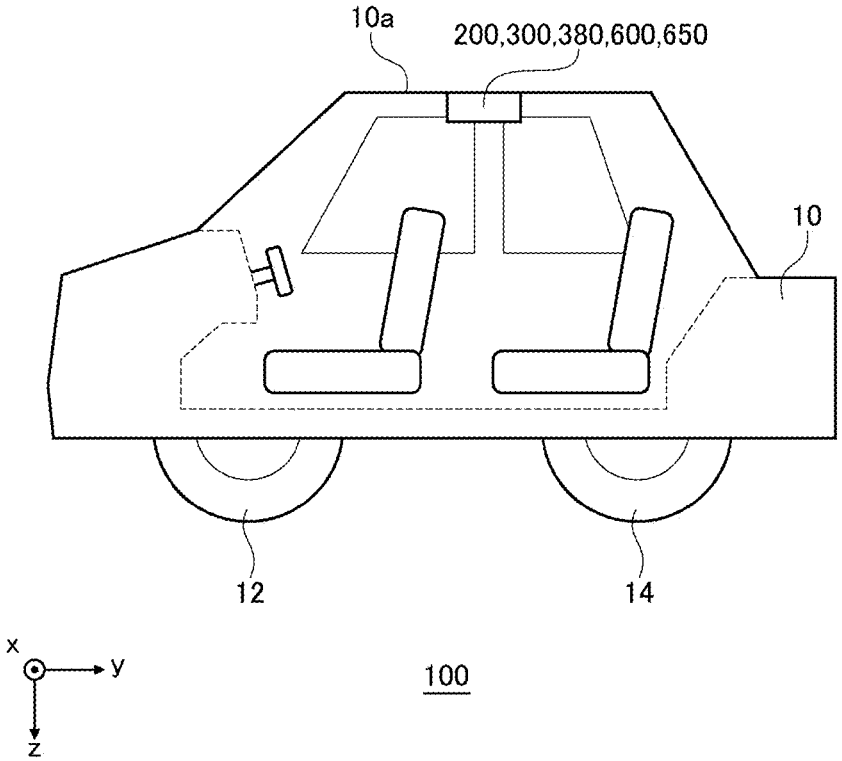
FIG. 16 shows a configuration of a vehicle according to another exemplary embodiment.

FIG. 16 shows a configuration of vehicle 100 according to another exemplary embodiment. Any of antenna 200, antenna 300, antenna 380, antenna 600, and antenna 650 may be installed on ceiling portion 10*a* inside vehicle 100. That is, antenna 200, antenna 300, antenna 380, antenna 600, and antenna 650 may be installed in an interior of vehicle 100.

Figure 17:
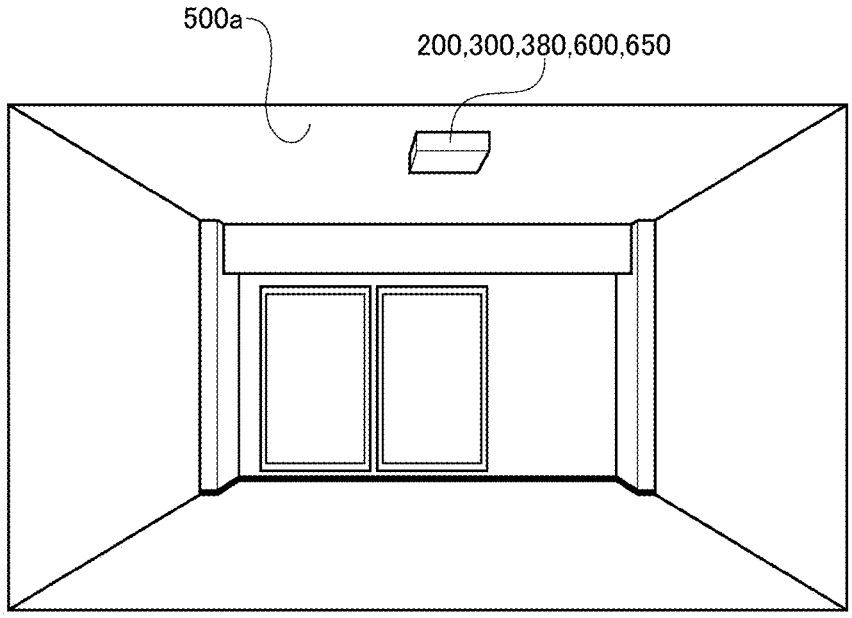
FIG. 17 shows a configuration of a room according to another exemplary embodiment.

FIG. 17 shows a configuration of a room according to another exemplary embodiment. Antenna 200, antenna 300, antenna 380, antenna 600, and antenna 650 may be installed inside a room 500 of a building, for example, instead of vehicle 100. Furthermore, antenna 200, antenna 300, antenna 380, antenna 600, and antenna 650 may be installed on ceiling portion 500*a* of room 500.

According to the exemplary embodiment, the second conductor and the third conductor that are electrically connected to each other in terms of high frequency are disposed at a distance from the feed element, and the third conductor is not electrically connected to the first conductor in terms of direct current. Thus, antenna radiation pattern toward surroundings is achieved. Also, the second distance between at least a part of the third conductor and the first conductor is less than twice the first distance between the feed element and the first conductor. Thus, antenna radiation pattern toward surroundings is achieved. Moreover, since the second distance is less than the first distance, capacitive coupling increases. Further, the second conductor and the third conductor are disposed orthogonal to each other, allowing the directors to be reduced in size. Furthermore, the reduced director size enables the antenna to become smaller. Also, the second conductor is disposed to avoid overlap with the center point of the feed element. This allows current distribution to be formed on the first conductor. In addition, since the current distribution is formed on the first conductor, antenna radiation pattern is controllable. Moreover, the second conductor is integral with the third conductor, thereby allowing both the second conductor and the third conductor to be reduced in length. Further, the reduced length of the second conductor enables the antenna to become smaller.

Also, the supporting member as an insulator is disposed between the first conductor and the second conductor and between the first conductor and the third conductor. Thus, potentials of the second conductor and the third conductor are kept separate from the ground. Additionally, since the potentials of the second conductor and the third conductor are kept separate from the ground, the second conductor and the third conductor can be used as the directors. Also, the first shape is larger in area than the third shape, which enables radiation to be emitted. Further, space is kept between the at least part of the third conductor and the first conductor. Thus, capacitive coupling occurs. Furthermore, since capacitive coupling occurs, antenna radiation pattern is controllable. Moreover, the distance between the at least part of the third conductor and the first conductor is greater than 0 mm and not more than 5 mm. This allows capacitive coupling to occur. Further, one side of the rectangle of the second shape has a length of substantially 30 mm. The antenna is thus reduced in size. Also, one side of the rectangle of the third shape has a length of substantially 32 mm. The antenna is thus reduced in size. Further, the length of the one side of the rectangle of the third shape is within 32±10% mm, allowing for greater design flexibility. Also, due to capacitance coupling, the second conductor and the first L-shaped conductor are electrically connected to each other in terms of high frequency. This eliminates the need to connect the second conductor and the first L-shaped conductor.

Moreover, the second conductor and the at least part of the third conductor are disposed along the direction in which the feed point is disposed with respect to the center point (for example, the center of gravity). Thus, radiation pattern in the direction in which the amount of radiation is large is adjustable. In addition, narrower radiation pattern is achievable by making the second shape smaller in width than the third shape. Also, broader radiation pattern is achievable by making the second shape greater in width than the third shape. Further, the fifth conductor and the sixth conductor are additionally disposed. Thus, radiation pattern can be controlled more finely. Furthermore, the fifth conductor and the sixth conductor are symmetric to the second conductor and the third conductor with respect to the feed element, thereby achieving antenna radiation pattern toward surroundings. Moreover, since the seventh conductor and the eighth conductor are additionally disposed, radiation pattern can be controlled more finely.

Also, the feed element and the second conductor are arranged in a traveling direction of the vehicle. Thus, radiation pattern toward the traveling direction of the vehicle is controllable. In addition, since the radiation pattern toward the traveling direction of the vehicle is controllable, radiation pattern which increases in the forward direction is achievable. Also, the supporting member is included in the body of the vehicle, thereby achieving a simplified configuration. Further, the second conductor is disposed at a distance from the first conductor with respect to the body of the vehicle. Thus, current distribution is formed on the first conductor. In addition, the traveling direction is a direction that is orthogonal to the rotation axis of the fixed wheels and parallel to the road surface where vehicle 100 is placed. This allows for arrangement of the feed element and the second conductor in the direction that is orthogonal to the rotation axis of the fixed wheels and parallel to the road surface where vehicle 100 is placed.

The present disclosure has been described according to the exemplary embodiments. It will be understood by those skilled in the art that the exemplary embodiments are merely examples; that other exemplary modifications, in which components of the exemplary embodiments are variously combined, are possible; and that the other exemplary modifications still fall within the scope of the present disclosure.

An outline of an aspect of the present disclosure is as follows.

(Item 1)

An antenna includes a first conductor, a feed element, a second conductor, and a third conductor. The first conductor has a surface having a first shape in plan view. The feed element is disposed over the surface of the first conductor. The second conductor is disposed over the surface of the first conductor at a distance from the feed element. The distance is greater than a distance between the feed element and the surface. The second conductor has a second shape that is a sheet-like shape in plan view. The second conductor is disposed to overlap the surface of the first conductor when viewed from a direction perpendicular to the surface of the first conductor. The third conductor is electrically connected to the second conductor at least in terms of high frequency. At least a part of the third conductor is located closer to the first conductor than the second conductor is located, in the direction perpendicular to the surface of the first conductor. The first shape is larger in area than the second shape. The at least the part of the third conductor is located farther than a part of the second conductor with respect to the feed element in a direction along the surface of the first conductor. The third conductor is not electrically connected to the first conductor in terms of direct current. A first distance exists between the feed element and the first conductor. A second distance exists between the at least the part of the third conductor and the first conductor. The second distance is less than twice the first distance.

According to this aspect, the second distance between the at least the part of the third conductor and the first conductor is less than twice the first distance between the feed element and the first conductor. Thus, antenna radiation pattern suited for a required application is achieved.

(Item 2)

In the antenna described in Item 1, the second distance may be less than the first distance.

In this case, since the second distance is less than the first distance, capacitive coupling increases.

(Item 3)

In the antenna described in Item 1, the second conductor may be disposed to avoid overlap at least a center point of the feed element.

In this case, the second conductor is disposed to avoid overlap a center point of the feed element. Thus, current distribution is formed on the first conductor.

(Item 4)

In the antenna described in Item 1, the second conductor may be integral with the third conductor.

In this case, since the second conductor is integral with the third conductor, the second conductor and the third conductor are both reduced in length.

(Item 5)

In the antenna described in Item 1, via capacitance coupling, the second conductor and the third conductor may be electrically connected to each other in terms of high frequency.

In this case, due to capacitance coupling, the second conductor and the third conductor are electrically connected to each other in terms of high frequency. This eliminates the need to connect the second conductor and the third conductor.

(Item 6)

The antenna described in Item 1 may further include insulators disposed at least between the first conductor and the second conductor and between the first conductor and the third conductor.

In this case, an insulator is disposed between the first conductor and the second conductor and between the first conductor and the third conductor. Thus, potentials of the second conductor and the third conductor are kept separate from the ground.

(Item 7)

In the antenna described in Item 1, the feed element may include a fourth conductor having a sheet-like shape having a third shape in plan view. The fourth conductor is disposed to overlap the surface of the first conductor when viewed from the direction perpendicular to the first conductor. The first shape may be larger in area than the third shape.

In this case, since the first shape is larger in area than the third shape, radiation can be emitted.

(Item 8)

The antenna described in Item 1 may further include a supporting member configured to support the second conductor, while keeping space between the at least the part of the third conductor and the first conductor.

In this case, space is kept between the at least the part of the third conductor and the first conductor. This allows capacitive coupling to occur.

(Item 9)

In the antenna described in Item 1, a distance between the at least the part of the third conductor and the first conductor may be substantially greater than 0 mm and not more than 5 mm.

In this case, the distance between the at least the part of the third conductor and the first conductor is greater than 0 mm and not more than 5 mm. This allows capacitive coupling to occur.

(Item 10)

In the antenna described in Item 1, the second shape of the second conductor may be a rectangle, and one side of the rectangle of the second shape may have a length of substantially 30 mm.

In this case, since one side of the rectangle of the second shape has a length of substantially 30 mm, the antenna is reduced in size.

(Item 11)

In the antenna described in Item 7, the third shape of the fourth conductor may be a rectangle, and one side of the rectangle of the third shape may have a length of substantially 32 mm.

In this case, since one side of the rectangle of the third shape has a length of substantially 32 mm, the antenna is reduced in size.

(Item 12)

In the antenna described in Item 11, the length of the one side of the rectangle of the third shape may be within 32±10% mm.

In this case, since the length of the one side of the rectangle of the third shape is within 32±10% mm, design flexibility is increased.

(Item 13)

In the antenna described in Item 7, the fourth conductor may have a feed point located at a predetermined distance from a center of gravity of the third shape in a predetermined direction along the surface of the first conductor, and the second conductor and the at least the part of the third conductor may be disposed along the predetermined direction.

In this case, the second conductor and the at least the part of the third conductor are disposed along the predetermined direction. This enables adjustment of radiation pattern in the direction in which the amount of radiation is large.

(Item 14)

In the antenna described in Item 13, the second shape of the second conductor may be smaller in width than the third shape of the fourth conductor in a direction that is along the surface of the first conductor and orthogonal to the predetermined direction.

In this case, since the second shape is smaller in width than the third shape, narrower radiation pattern is achieved.

(Item 15)

In the antenna described in Item 13, the second shape of the second conductor may be greater in width than the third shape of the fourth conductor in a direction that is along the surface of the first conductor and orthogonal to the predetermined direction.

In this case, since the second shape is greater in width than the third shape, broader radiation pattern is achieved.

(Item 16)

The antenna described in Item 13 may further include a fifth conductor and a sixth conductor. The fifth conductor is disposed over the surface of the first conductor at a distance from the feed element. The distance is greater than a distance between the feed element and the surface. The fifth conductor has the second shape that is a sheet-like shape in plan view. The fifth conductor is disposed to overlap the surface of the first conductor when viewed from the direction perpendicular to the first conductor. The sixth conductor is electrically connected to the fifth conductor at least in terms of high frequency. At least a part of the sixth conductor is located closer to the first conductor than the fifth conductor is located, in the direction perpendicular to the surface of the first conductor. The first shape may be larger in area than the second shape. The at least the part of the sixth conductor may be located farther than a part of the fifth conductor with respect to the feed element in the direction along the surface of the first conductor. The sixth conductor does not need to be electrically connected to the first conductor in terms of direct current. The second conductor, the at least the part of the third conductor, the fifth conductor, and the at least the part of the sixth conductor may be disposed along the predetermined direction.

In this case, the fifth conductor and the sixth conductor are additionally disposed, enabling radiation pattern to be controlled more finely.

(Item 17)

The antenna described in Item 16 may further include a seventh conductor and an eighth conductor. The seventh conductor is disposed over the surface of the first conductor at a distance from the feed element. The distance is greater than a distance between the feed element and the surface. The seventh conductor has the second shape that is a sheet-like shape in plan view. The seventh conductor is disposed to overlap the surface of the first conductor when viewed from the direction perpendicular to the first conductor. The eighth conductor is disposed over the surface of the first conductor at a distance from the feed element. The distance is greater than a distance between the feed element and the surface. The eighth conductor has the second shape that is a sheet-like shape in plan view. The eighth conductor is disposed to overlap the surface of the first conductor when viewed from the direction perpendicular to the first conductor.

In this case, the seventh conductor and the eighth conductor are additionally disposed, enabling radiation pattern to be controlled more finely.

(Item 18)

A vehicle includes an antenna, and a supporting member configured to support the antenna. The antenna includes a first conductor, a feed element, a second conductor, and a third conductor. The first conductor has a surface having a first shape in plan view. The feed element is disposed over the surface of the first conductor. The second conductor is disposed over the surface of the first conductor at a distance from the feed element. The distance is greater than a distance between the feed element and the surface. The second conductor has a second shape that is a sheet-like shape in plan view. The second conductor is disposed to overlap the surface of the first conductor when viewed from a direction perpendicular to the surface the first conductor. The third conductor is electrically connected to the second conductor at least in terms of high frequency. At least a part of the third conductor is located closer to the first conductor than the second conductor is located, in the direction perpendicular to the surface of the first conductor. The first shape is larger in area than the second shape. The at least the part of the third conductor is located farther than a part of the second conductor with respect to the feed element in a direction along the surface of the first conductor. The third conductor is not electrically connected to the first conductor in terms of direct current. A first distance exists between the feed element and the first conductor. A second distance exists between the at least the part of the third conductor and the first conductor. The second distance is less than twice the first distance. The feed element and the second conductor are disposed along a predetermined direction parallel to the surface of the first conductor. The supporting member supports the antenna, with the predetermined direction corresponding to a traveling direction of the vehicle.

According to this aspect, the second distance between the at least the part of the third conductor and the first conductor is less than twice the first distance between the feed element and the first conductor. Thus, antenna radiation pattern suited for a required application is achieved.

(Item 19)

In the vehicle described in Item 18, the second distance may be less than the first distance.

In this case, since the second distance is less than the first distance, capacitive coupling increases.

(Item 20) In the vehicle described in Item 18, the supporting member may include a body of the vehicle.

In this case, since the supporting member is included in a body of the vehicle, a simplified configuration is achieved.

(Item 21)

In the vehicle described in Item 18, the second conductor may be disposed at a distance from the first conductor with respect to a body of the vehicle.

In this case, the second conductor is disposed at a distance from the first conductor with respect to a body of the vehicle. This allows current distribution to be formed on the first conductor.

(Item 22)

The vehicle described in Item 18 may further include a fixed wheel that is not steered. The traveling direction may be a direction that is orthogonal to a rotation axis of the fixed wheel and parallel to a road surface.

In this case, the traveling direction is a direction that is orthogonal to the rotation axis of the fixed wheel and parallel to the road surface. This enables the feed element and the second conductor to be arranged in the direction that is orthogonal to the rotation axis of the fixed wheel and parallel to the road surface.

(Item 23)

In the vehicle described in Item 18, the at least the part of the third conductor may be located farther than the part of the second conductor with respect to the feed element in the predetermined direction.

In this case, the second conductor and the third conductor that are electrically connected to each other in terms of high frequency are disposed at a distance from the feed element, and the third conductor is not electrically connected to the first conductor in terms of direct current. Thus, antenna radiation pattern suited for a required application is achieved.

In the exemplary embodiments of the present disclosure, supporting member 316 is formed on dielectric substrate 308. The supporting member, however, is not limited to this, but may include body 10 of vehicle 100, for example. In that case, second conductor 322, for example, may be attached on a side of body 10 on which dielectric substrate 308 is disposed, that is, a backside of body 10. According to the modified examples, simplified configurations are achieved.

The present disclosure relates to an antenna technique, and is particularly applicable to an antenna having a feed element disposed on a substrate, and a vehicle.

What is claimed is:

1. An antenna comprising:

a first conductor having a surface having a first shape in plan view;

a feed element disposed over the surface of the first conductor;

a second conductor disposed over the surface of the first conductor at a distance from the feed element, the distance being greater than a distance between the feed element and the surface, the second conductor having a second shape that is a sheet-like shape in plan view, the second conductor being disposed to overlap the surface of the first conductor when viewed from a direction perpendicular to the surface of the first conductor; and a third conductor electrically connected to the second conductor at least in terms of high frequency, at least a part of the third conductor being located closer to the first conductor than the second conductor is located, in the direction perpendicular to the surface of the first conductor, wherein the first shape is larger in area than the second shape, the at least the part of the third conductor is located farther than a part of the second conductor with respect to the feed element in a direction along the surface of the first conductor, the third conductor is not electrically connected to the first conductor in terms of direct current, a first distance exists between the feed element and the first conductor, a second distance exists between the at least the part of the third conductor and the first conductor, and the second distance is less than twice the first distance.

2. The antenna according to claim 1, wherein the second distance is less than the first distance.

3. The antenna according to claim 1, wherein the second conductor is disposed to avoid overlap at least a center point of the feed element.

4. The antenna according to claim 1, wherein the second conductor is integral with the third conductor.

5. The antenna according to claim 1, wherein via capacitance coupling, the second conductor and the third conductor are electrically connected to each other in terms of high frequency.

6. The antenna according to claim 1, further comprising insulators disposed at least between the first conductor and the second conductor and between the first conductor and the third conductor.

7. The antenna according to claim 1, wherein the feed element includes a fourth conductor having a sheet-like shape having a third shape in plan view, the fourth conductor being disposed to overlap the surface of the first conductor when viewed from the direction perpendicular to the first conductor, and the first shape is larger in area than the third shape.

8. The antenna according to claim 1, further comprising a supporting member configured to support the second conductor, while keeping space between the at least the part of the third conductor and the first conductor.

9. The antenna according to claim 1, wherein a distance between the at least the part of the third conductor and the first conductor is substantially greater than 0 mm and not more than 5 mm.

10. The antenna according to claim 1, wherein the second shape of the second conductor is a rectangle, and one side of the rectangle of the second shape has a length of substantially 30 mm.

11. The antenna according to claim 7, wherein the third shape of the fourth conductor is a rectangle, and one side of the rectangle of the third shape has a length of substantially 32 mm.

12. The antenna according to claim 11, wherein the length of the one side of the rectangle of the third shape is within 32±10% mm.

13. The antenna according to claim 7, wherein the fourth conductor has a feed point located at a predetermined distance from a center of gravity of the third shape in a predetermined direction along the surface of the first conductor, and the second conductor and the at least the part of the third conductor are disposed along the predetermined direction.

14. The antenna according to claim 13, wherein the second shape of the second conductor is smaller in width than the third shape of the fourth conductor in a direction that is along the surface of the first conductor and orthogonal to the predetermined direction.

15. The antenna according to claim 13, wherein the second shape of the second conductor is greater in width than the third shape of the fourth conductor in a direction that is along the surface of the first conductor and orthogonal to the predetermined direction.

16. The antenna according to claim 13, further comprising:

a fifth conductor disposed over the surface of the first conductor at a distance from the feed element, the distance being greater than a distance between the feed element and the surface, the fifth conductor having the second shape that is a sheet-like shape in plan view, the fifth conductor being disposed to overlap the surface of the first conductor when viewed from the direction perpendicular to the first conductor; and a sixth conductor electrically connected to the fifth conductor at least in terms of high frequency, at least a part of the sixth conductor being located closer to the first conductor than the fifth conductor is located, in the direction perpendicular to the surface of the first conductor, wherein the first shape is larger in area than the second shape, the at least the part of the sixth conductor is located farther than a part of the fifth conductor with respect to the feed element in the direction along the surface of the first conductor, the sixth conductor is not electrically connected to the first conductor in terms of direct current, and the second conductor, the at least the part of the third conductor, the fifth conductor, and the at least the part of the sixth conductor are disposed along the predetermined direction.

17. The antenna according to claim 16, further comprising:

a seventh conductor disposed over the surface of the first conductor at a distance from the feed element, the distance being greater than a distance between the feed element and the surface, the seventh conductor having the second shape that is a sheet-like shape in plan view, the seventh conductor being disposed to overlap the surface of the first conductor when viewed from the direction perpendicular to the first conductor; and an eighth conductor disposed over the surface of the first conductor at a distance from the feed element, the distance being greater than a distance between the feed element and the surface, the eighth conductor having the second shape that is a sheet-like shape in plan view, the eighth conductor being disposed to overlap the surface of the first conductor when viewed from the direction perpendicular to the first conductor.

18. A vehicle comprising:

an antenna; and a supporting member configured to support the antenna, wherein the antenna includes:

a first conductor having a surface having a first shape in plan view;

a feed element disposed over the surface of the first conductor;

a second conductor disposed over the surface of the first conductor at a distance from the feed element, the distance being greater than a distance between the feed element and the surface, the second conductor having a second shape that is a sheet-like shape in plan view, the second conductor being disposed to overlap the surface of the first conductor when viewed from a direction perpendicular to the surface of the first conductor; and a third conductor electrically connected to the second conductor at least in terms of high frequency, at least a part of the third conductor being located closer to the first conductor than the second conductor is located, in the direction perpendicular to the surface of the first conductor, the first shape is larger in area than the second shape, the at least the part of the third conductor is located farther than a part of the second conductor with respect to the feed element in a direction along the surface of the first conductor, the third conductor is not electrically connected to the first conductor in terms of direct current, a first distance exists between the feed element and the first conductor, a second distance exists between the at least the part of the third conductor and the first conductor, the second distance is less than twice the first distance, the feed element and the second conductor are disposed along a predetermined direction parallel to the surface of the first conductor, and the supporting member supports the antenna, with the predetermined direction corresponding to a traveling direction of the vehicle.

19. The vehicle according to claim 18, wherein the second conductor is disposed at a distance from the first conductor with respect to a body of the vehicle.

20. The vehicle according to claim 18, wherein the at least the part of the third conductor is located farther than the part of the second conductor with respect to the feed element in the predetermined direction.

* * * * *